US011306562B1

(12) United States Patent
Giroux et al.

(10) Patent No.: US 11,306,562 B1
(45) Date of Patent: Apr. 19, 2022

(54) STAGE TOOL HAVING COMPOSITE SEATS

(71) Applicant: Weatherford Technology Holdings, LLC, Houston, TX (US)

(72) Inventors: Richard L. Giroux, Belville, TX (US); Eric R. Evans, Magnolia, TX (US); Joshua V. Symms, Cypress, TX (US); Yidara Wolf, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/242,439

(22) Filed: Apr. 28, 2021

(51) Int. Cl.
*E21B 34/14* (2006.01)
*E21B 33/14* (2006.01)

(52) U.S. Cl.
CPC ..... *E21B 34/142* (2020.05); *E21B 33/146* (2013.01); *E21B 2200/06* (2020.05)

(58) Field of Classification Search
CPC .... E21B 34/142; E21B 34/14; E21B 2200/06; E21B 33/16
See application file for complete search history.

(56) References Cited

U.S. PATENT DOCUMENTS 2,872,983 A * 2/1959 Renouf ..... E21B 33/14 166/141
3,062,296 A * 11/1962 Brown ..... E21B 21/10 166/320
3,223,160 A 12/1965 Baker
3,524,503 A 8/1970 Baker
3,768,556 A 10/1973 Baker
3,811,500 A * 5/1974 Morrisett ..... E21B 33/16 166/154
3,948,322 A 4/1976 Baker
4,246,968 A 1/1981 Jessup et al.
4,674,569 A 6/1987 Revils et al.
5,178,216 A 1/1993 Giroux et al.
5,348,089 A * 9/1994 Brandell ..... E21B 33/146 166/154
6,651,743 B2 11/2003 Szarka
8,800,655 B1 8/2014 Bailey
9,816,351 B2 11/2017 Lirette et al.
(Continued)

OTHER PUBLICATIONS

Weatherford. "Eliminator(TM) H Model 754 Stage Tool." Tech Specs. Cementing Products Stage Cementing Tool. 2008-2016 Weatherford. 2 pages.

*Primary Examiner* — Kipp C Wallace
(74) *Attorney, Agent, or Firm* — Blank Rome LLP

(57) ABSTRACT

A stage tool used in a wellbore has a housing consisting of two sub-housings that couple together. A first sleeve is movably disposed in the housing bore and is held closed with a temporary connection relative to a side port of the housing. The first sleeve has a first seat of millable material. A second sleeve is also movably disposed in the housing bore and is held opened with a temporary connection relative to the side port. The second sleeve has a second seat of millable material. An opening plug is landed on the first seat so pressure can break the connection and shift the first sleeve open relative to the side port. After pumping cement out of the tool, a closing plug is pumped to the second seat so pressure can break the connection and shift the second sleeve closed relative to the side port. The first sleeve includes a bypass that allows for fluid to pass beyond the seated plug.

22 Claims, 14 Drawing Sheets

(56) References Cited

U.S. PATENT DOCUMENTS

| | | | | |
|---|---|---|---|---|
| 9,885,222 | B2 * | 2/2018 | Andrigo | E21B 33/12 |
| 9,909,390 | B2 | 3/2018 | McNabb et al. | |
| 10,246,968 | B2 | 4/2019 | Budde et al. | |
| 10,655,428 | B2 | 5/2020 | Giroux et al. | |
| 2003/0192694 | A1 * | 10/2003 | Zachman | E21B 43/045 166/278 |
| 2014/0076560 | A1 | 3/2014 | Kenyon et al. | |
| 2015/0159469 | A1 * | 6/2015 | Purkis | E21B 34/106 166/373 |
| 2016/0138367 | A1 * | 5/2016 | Lirette | E21B 43/26 166/285 |
| 2017/0342800 | A1 * | 11/2017 | Themig | E21B 33/146 |
| 2019/0178052 | A1 | 6/2019 | Giroux et al. | |

* cited by examiner

STAGE TOOL HAVING COMPOSITE SEATS

BACKGROUND OF THE DISCLOSURE

Cementing operations are used in wellbores to fill the annular space between casing and the formation with cement. When this is done, the cement sets the casing in the wellbore and helps isolate production zones at different depths within the wellbore from one another. During the operation, the cement can be pumped into the annulus from the bottom of the casing (e.g., cementing the long way) or from the top of the casing (e.g., reverse cementing).

Due to weak earth formations or long strings of casing, cementing from the top or bottom of the casing may be undesirable or ineffective. For example, when circulating cement into the annulus from the bottom of the casing, problems may be encountered because a weak earth formation will not support the cement as the cement on the outside of the casing rises in the annulus. As a result, the cement may flow into the formation rather than up the casing annulus. When cementing from the top of the casing, it is often difficult to ensure the entire annulus is cemented.

For these reasons, staged cementing operations can be performed in which different sections or stages of the wellbore's annulus are filled with cement. To do such staged operations, various stage tools can be disposed on the casing string for circulating cement slurry pumped down the casing string into the wellbore annulus at particular locations.

A stage tool uses a seat to engage a plug, which is then used to open the tool with the application of pressure. The seat may typically be composed of aluminum so the seat can be readily drilled out after use. Because such a stage tool is hydraulically operated, the casing can be run in highly deviated wells where mechanical operation could be difficult.

After use, stage tools are drilled out. The seats composed of aluminum can cause excessive wear on the bits used to mill out the tools. The bit in some cases is run on a bent sub to aid in the drilling of a horizontal hole after the drilling assembly exits the bottom of the casing. Because the bit is at a slight angle during the drill out of the stage tool, the chances of the bit digging into the portions of the tool that seal off the tool's ports are increased. This "digging in" can also cause the seals to leak.

Composite seats can be used in stage tools instead of aluminum, but these composite seats may have reduced performance. In fact, operators who have attempted to use composite seats in stage tools have tended to abandon the practice due to performance issues and have reverted back to using aluminum seats in their stage tools.

Although existing stage tool designs may be effective, operators are continually striving to simplify the manufacture of a stage tool, improve the tool's operation, and to facilitate milling out of the tool. The subject matter of the present disclosure is directed to overcoming, or at least reducing the effects of, one or more of the problems set forth above.

SUMMARY OF THE DISCLOSURE

A stage tool disclosed herein is used in a wellbore. The stage tool is opened with a first plug and is closed with a second plug. The stage tool comprises a housing, a first sleeve, and a second sleeve. The housing has an internal bore and defines a side port, which communicates the internal bore with the wellbore.

The first sleeve is movably disposed in the internal bore and is held in a first closed position with a first temporary connection. The first temporary connection is releasable in response to a first force. The first sleeve in the first closed position closes communication between the side port and the internal bore. The first sleeve has a first seat disposed therein. The first seat is configured to engage the first plug and is composed of a first millable material. The first sleeve in response to release of the first temporary connection due to the first force is movable from the first closed position to a first opened position. The first sleeve in the first opened position opens communication between the side port and the internal bore, and the first sleeve in a final position in the bore has a first engagement with the internal bore configured to prevent rotation of the first sleeve.

The second sleeve is movably disposed in the internal bore and is held with a second temporary connection. The second temporary connection is releasable in response to a second force. The second sleeve in a second opened position opens communication between the side port and the internal bore, and the second sleeve has a second seat disposed therein. The second seat is configured to engage the second plug and is composed of a second millable material. The second sleeve in response to release of the second temporary connection due to the second force is movable from the second opened position to a second closed position. The second sleeve in the second closed position closes communication between the side port and the internal bore. The second sleeve in the second closed position has a second engagement with the first sleeve configured to prevent rotation of the second sleeve.

The foregoing summary is not intended to summarize each potential embodiment or every aspect of the present disclosure.

DETAILED DESCRIPTION OF THE DISCLOSURE

Figure 1:
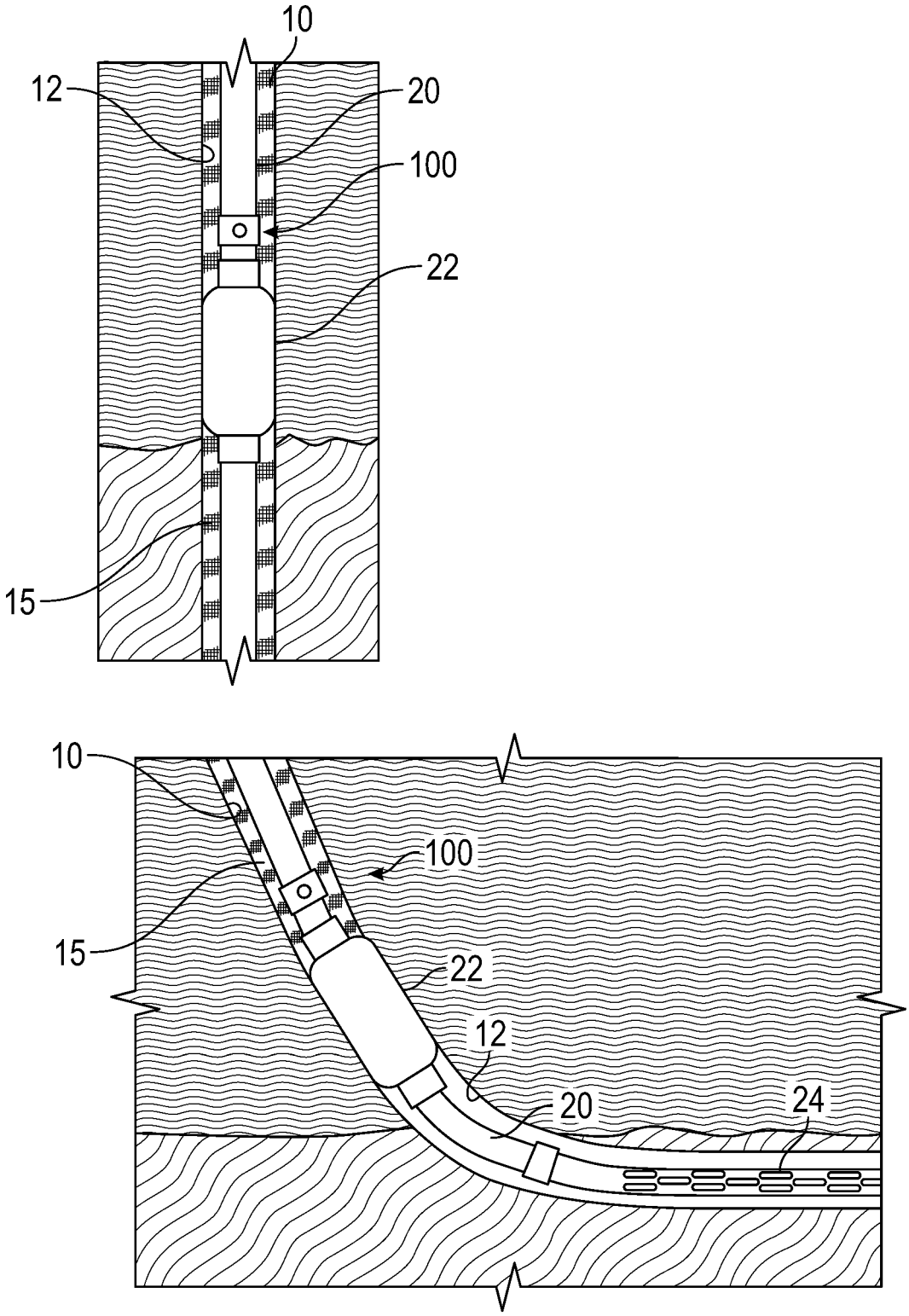
FIG. 1 (Prior Art)
FIG. 1 illustrates an assembly having a stage tool, a packer, and a wellscreen disposed on casing to be cemented in a wellbore.

FIG. 1 illustrates an assembly according to the present disclosure having a stage tool 100 and a packer 22 on a casing string 20, liner, or the like disposed in a wellbore 10. The stage tool 100 allows the casing string 20 to be cemented in the wellbore 10 using two or more stages. In this way, the stage tool 100 and staged cementation operations can be used for zones in the wellbore 10 experiencing lost circulation, water pressure, low formation pressure, or high-pressure gas.

As shown, an annulus casing packer 22 can be run in conjunction with the stage tool 100 to assist cementing of the casing string 20 in the two or more stages. The stage tool 100 is typically run above the packer 22, allowing the lower zones of the wellbore 10 to remain uncemented and to prevent cement from falling downhole. One type of suitable packer 22 is Weatherford's BULLDOG ACP™ annulus casing packer. (ACP is registered trademarks of Weatherford/Lamb, Inc.)

Other than in a vertical bore, the stage tool 100 can be used in a deviated wellbore. As also shown, for example, the assembly 20 can have a slotted screen 24 below the packer 22.

During staged cementing, a lower stage having a weak zone in the formation can be cemented in a way that the hydrostatic pressure of the slurry of cement 15 does not damage the formation. To then cement the next stage, pressure can applied against the lower stage's plug so the casing packer 22 can be opened, inflated, and closed to isolate the lower annulus 12 below the packer 22 from being subject to further pressure increases. Instead of using a packer 22, the cement 15 in the lower stage may be allowed to set prior to cementing the next stage.

To cement this next stage, an opening plug or dart is landed in the stage tool 100 so pressure can be applied against the seated plug to open the stage tool 100. An amount of cement 15 is pumped down behind the opening plug, and the cement 15 is pumped out of the opened stage tool 100 into the annulus 12 of the zone. Once the cement 15 has filled the annulus 12, a closing wiper plug is then pumped behind the cement to then close the stage tool 100 for the zone. After cementing, the seats and the plugs in the stage tool 100 can be drilled/milled out to open fluid communication through the casing string 20. Multiple stages can be cemented in this manner.

Figure 2A:
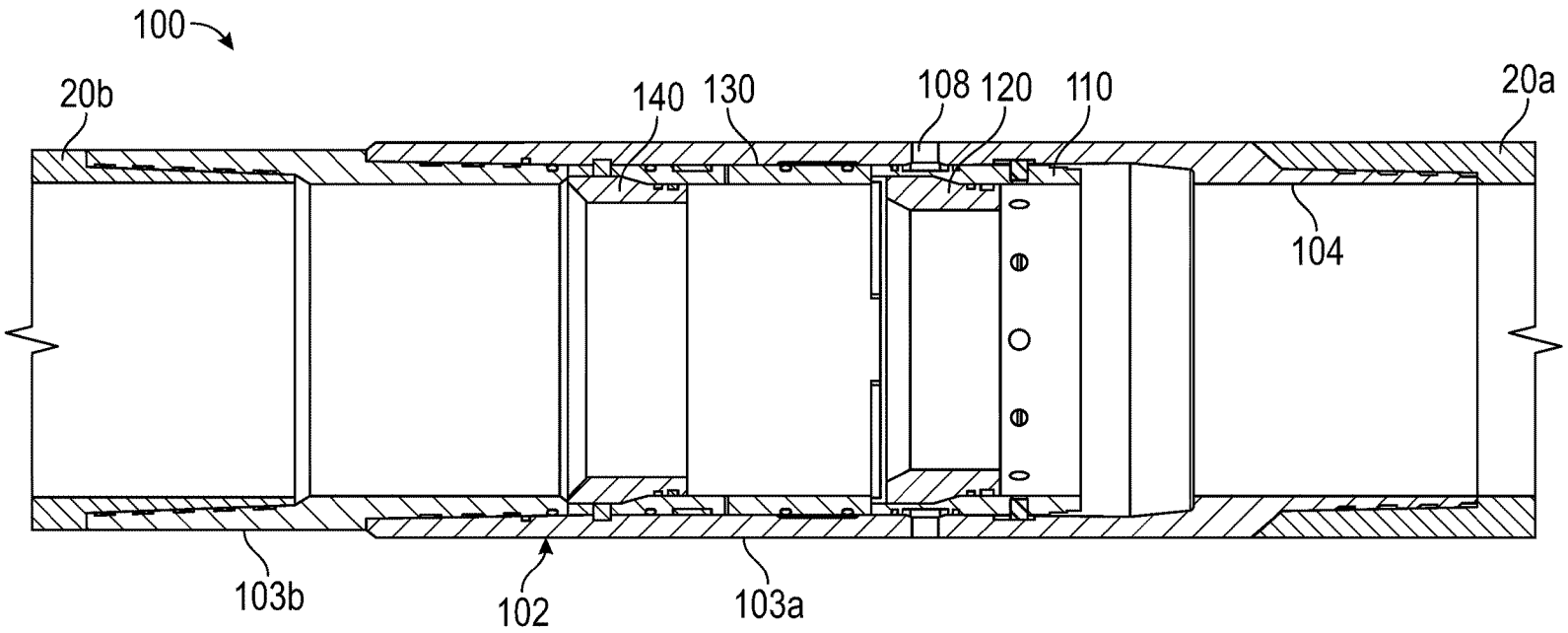
FIG. 2A illustrates a cross-sectional view of a first stage tool of the present disclosure in an initial closed condition.
Figure 2B:
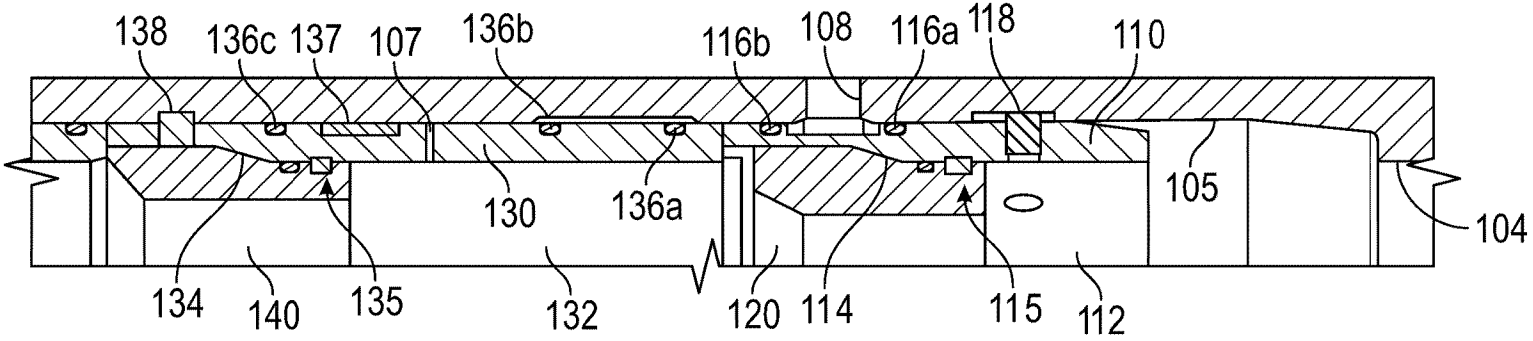
FIG. 2B illustrates a detail of FIG. 2A.
Figure 3A:
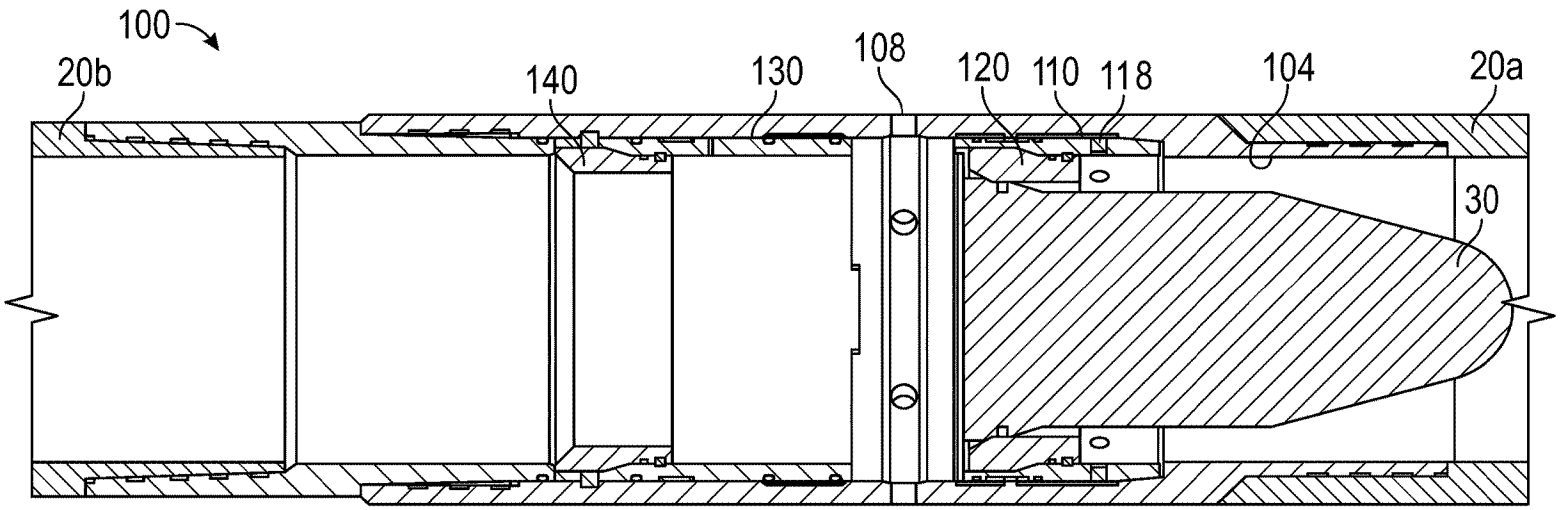
FIG. 3A illustrates a cross-sectional view of the stage tool in an opened condition.
Figure 3B:
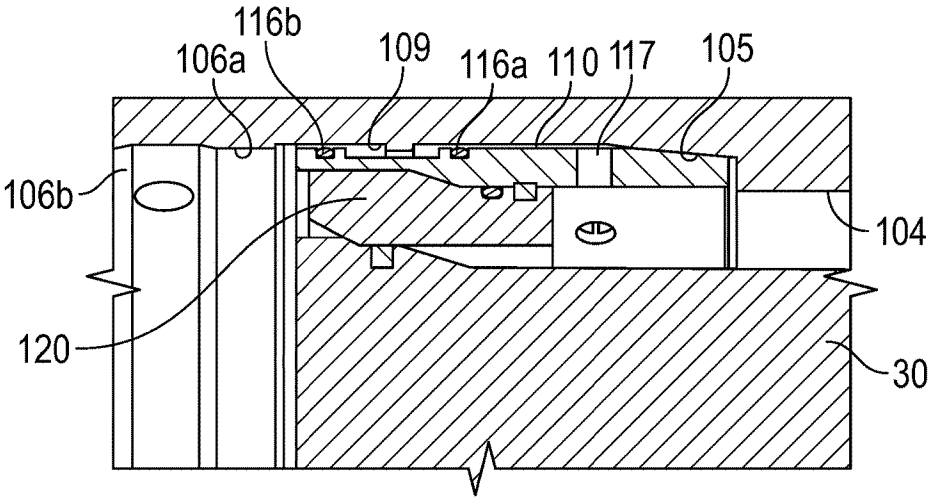
FIG. 3B illustrates a detail of FIG. 3A.
Figure 4A:
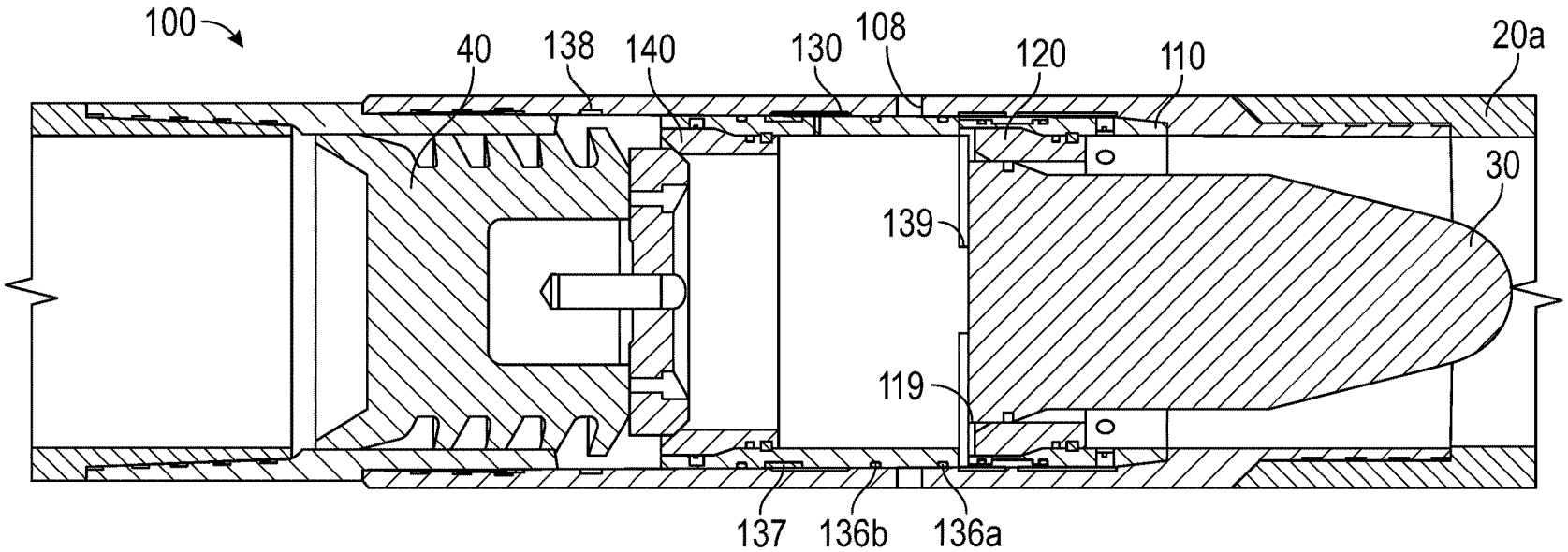
FIG. 4A illustrates a cross-sectional view of the stage tool in a final closed condition.
Figure 4B:
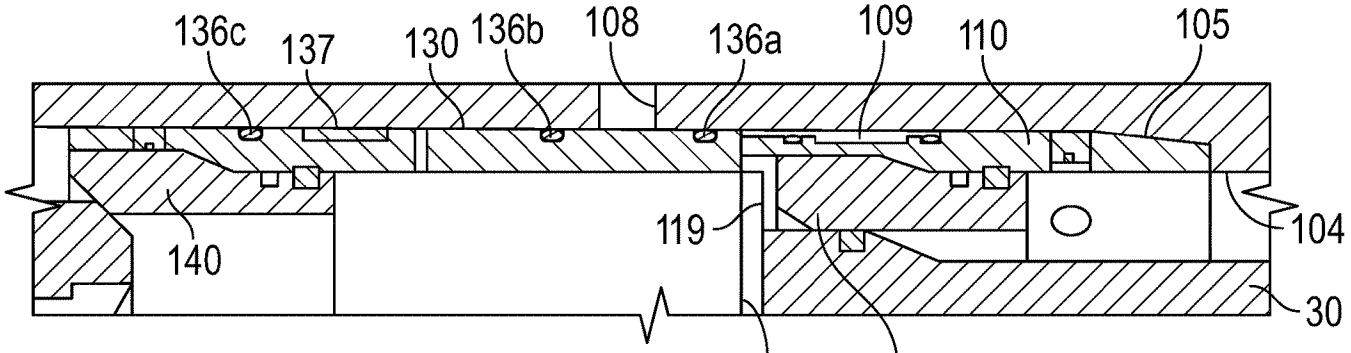
FIG. 4B illustrates a detail of FIG. 4A.
Figure 5:
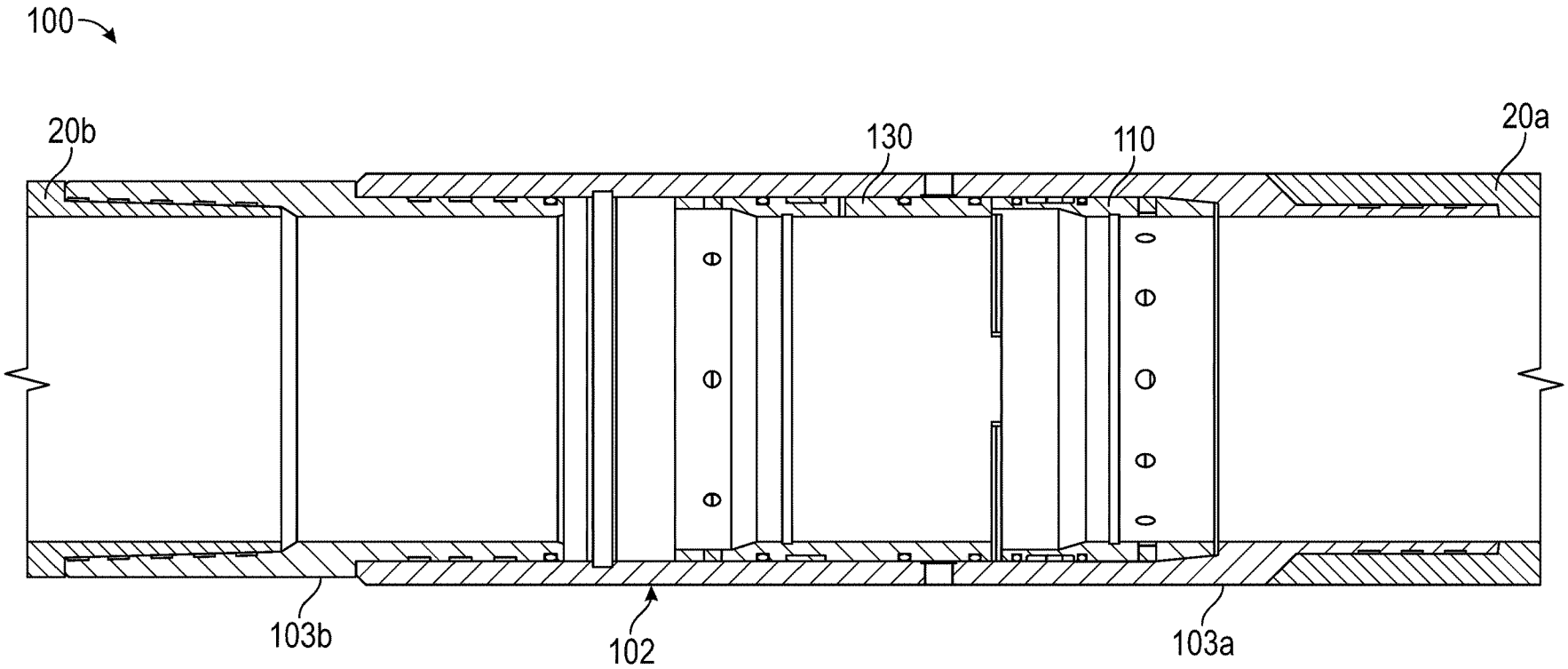
FIG. 5 illustrates a cross-sectional view of the stage tool having the seats milled out.

FIGS. 2A-2B, 3A-3B, 4A-4B, and 5 illustrate cross-sectional views of a stage tool 100 according to the present disclosure. In FIG. 2A, the stage tool 100 is shown in an initial closed condition for run-in downhole. In FIG. 3A, a first opening plug 30 is used to open the tool 100, while a second closing plug 40 in FIG. 4A is used to close the tool 100. Finally as shown in FIG. 5, seats 120, 140 and the plugs 30, 40 are milled out of the tool 100 after cementing operations are completed. connected to sections 20*a-b* of casing string at each end. The stage tool 100 can be used in an assembly as noted above in FIG. 1 or in another arrangement. The stage tool 100 is run on the casing string 20 and includes a housing 102 having an internal bore 104. One or more side ports 108 on the side of the housing 102 can communicate the internal bore 104 with the wellbore annulus (not shown) depending on the locations of an opening sleeve 110 and a closing sleeve 130 on the tool 100.

Looking at using the stage tool 100 during cementing operations, reference is made briefly to FIGS. 2A, 3A, 4A, and 5. During cementing operations as noted herein, plugs, such as an opening plug 30 (FIG. 3A) and a closing plug 40 (FIG. 4B), are used in a cementing system to close off the casing sections 20*a-b*, to open the stage tool 100 (by opening the opening sleeve 110), and to close the stage tool 100 (by closing the closing sleeve 130). For example, during stage cementing, the opening plug (30: FIG. 3A) is launched through the casing section 20*b* before cement is pumped downhole. Reaching the closed stage tool 100 as shown in FIG. 3A, the plug 30 lands in a first seat 120 of the opening sleeve 110 in the stage tool 100. Reaching the seat 120, the plug 30 then closes off the casing section 20*b* to make it a closed chamber system.

With the plug 30 landed as in FIG. 1, increased internal casing pressure hydraulically opens the stage tool 100 by allowing the opening sleeve 110 to shift down and expose the tool's ports 108, thus enabling circulation and stage cement to pass through the ports 108 and into the annulus above the tool 100. To do this, pressure is applied to the closed chamber system causes by the seated plug 30. The pressure in the casing section 20*b* acts on the differential area of the opening sleeve 110 and eventually breaks a temporary connection 118, such as shear pins, that hold the opening sleeve 110 in place. The stage tool 100 can be equipped with field-adjustable connections, such as these shear pins 118 as well as others, enabling operators to choose opening pressures suitable for specific well requirements.

When the temporary connection 118 releases (e.g., the shear pins break), the opening sleeve 110 then shifts down as shown in FIG. 3A, opening fluid communication through the ports 108 in the stage tool 100 to the surrounding annulus (not shown). The opening sleeve 110 is stopped when it reaches its lower limit of travel. At this point, the cement being pumped downhole is communicated out of the tool 100 through the open ports 108 so a stage cement job can be done. As discussed in more detail below, fluid communication is permitted further downhole through the tool 100 via a bypass 109.

When cementing the stage nears completion, a closing plug 40 (FIG. 4A) is released and wipes the casing ID clean of cement until it lands on a second composite seat 140 of the closing sleeve 130, as shown. Increased pressure releases another temporary connection 138 so the closing sleeve 130 can shift downward. The released sleeve 130 moves down across the ports 108, closing the tool 100. In particular, fluid pressure supplied behind the closing plug 40 can break shear pins of the temporary connection 138, allowing the closing sleeve 130 to shift down and close off the ports 108. A snap ring 137 can lock the sleeve 130 in position, ensuring the stage tool 100 remains locked. Eventually, the plugs 30 and 40 and seats 120, 140 can be milled/drilled out so that the stage tool 100 has an inner diameter consistent with the casing's inner diameter, as shown in FIG. 5.

The first and second seats 120, 140 as disclosed herein are preferably composed of composite material. The first composite seat 120 in the stage tool 100 needs the strength required to withstand load. The opening seat 120 along with the opening plug 30 need to withstand the lifting pressure of the stage of cement. (Cement can weigh several pounds more than the mud in the well, and it must be pumped up the annulus between the casing and the open hole.) This differential pressure is applied to the opening seat 120 and the opening plug 30. In 9⅝" size tubing, the area of the opening seat 120 may be 60 square inches or larger, thus a 1,000 psi lifting pressure may apply 60,000 lbf or more on the opening seat 120 and the opening plug 30. Moreover, in some operations, an annulus casing packer 22 is disposed above the stage tool 100 to mitigate gas migration by inflating the annulus casing packer 22 with cement. In this case, the closing seat 140 of the stage tool 100 must also withstand the application of lift pressure plus the inflation pressure for the packer 22. This pressure can be as high as 3,000 psi (potentially an 180,000 lbs. load).

Threaded, pinned, and/or grooved composite seats may have a problem withstanding the types of load detailed above. For this reason, the seats 120 and 140 of the present disclosure include a wedged configuration in which the seats 120 and 140 rest against wedged shoulders of the respective sleeve 110 and 130, as discussed in more detail below. The tool 100 uses the composite seats 130, 140 to move the sleeves 110, 120 down once the plug 30, 40 lands. The tool 100 does not require the composite seats 130, 140 to break of screws/pins for the seats to move down. That's done by the metal sleeves 110, 120. This design makes the composite seats 130, 140 easier to manufacture and drill out. The plugs 30, 40 used with the tool 100 can include existing opening plugs (e.g., cones) and closing wiper plugs.

The two sleeve stage tool 100 addresses hydraulic lock in a unique way. The features of the disclosed stage tool 100 seek a solution for the hydraulic lock problem seen when two sleeves 110, 130 come together in the stage tool 100 with no place for the fluid between the upper and lower sleeves 110, 130 to escape once the ports 108 are closed. The new solution to this problem uses the opening sleeve 110 and undercuts in the inside diameter of the stage tool's housing 102 as a bypass 109 to allow the fluid to access the "infinite reservoir" below the stage tool 100 so the compressed fluids between the two sleeves 110, 130 can escape. When the stage tool 100 is opened, the opening seat 120 moves down and does not hold lifting pressure, e.g. like a hydraulically opened stage tool. This removes the protentional for hydraulic lock to occur when the closing sleeve 130 eventually covers the ports 108 after being pumped down by the closing plug 40.

As noted above and as shown in FIG. 2A, the stage tool 100 includes the housing 102 having the internal bore 104 and defining the one or more side ports 108 that communicate the internal bore 104 with the wellbore. The housing 102 has a simplified configuration that includes only two subcomponents, namely a pin sub-housing 103*a* and a box sub-housing 103*b*. The pin sub-housing 103*a* has a pin end for connecting to other tubulars, such as the downhole casing section 20*a*, while the box sub-housing 103*b* has a box end connecting to other tubulars, such as the uphole casing section 20*b*. Connection ends of these sub-housings 103*a-b* couple together to complete the housing 102 of the tool 100. This configuration facilitates assembly of the tool 100 so that a number of conventional housing features, such as three or more housing components, lock nuts, additional housing seals, etc., are not needed. The pin and box sub-housings 103*a-b* can be composed of conventional metals used for downhole tools.

As noted above and as shown in FIG. 2A, the stage tool 100 includes the first, opening sleeve 110 and the second, closing sleeve 130. In the present configuration, the two sleeves 110, 130 are unconnected to one another so that the opening sleeve 110 is separately movable in the internal bore 104 relative the closing sleeve 130.

The opening sleeve 110 is movably disposed in the internal bore 104 and is held in a first closed position (FIG. 2A) with the first temporary connection 118, which is releasable in response to a first force. As best shown in FIG. 2B, the first temporary connection 118 includes shear pins engaged between the opening sleeve 110 and the housing's internal bore 104. During assembly, the opening sleeve 110 can be positioned in the housing's internal bore 104 of the sub-housing 103*a* with the other sub-housing 103*b* not yet connected. The shear pins 118 can be threaded through holes in the internal passage 112 of the opening sleeve 110 to hold the sleeve 110 in place.

The opening sleeve 110 is initially held in a first closed position that covers the side ports 108 and closes communication between the side ports 108 and the internal bore 104. In particular and as best seen in FIG. 2B, a sidewall of the opening sleeve 110 has seals 116*a-b* disposed externally thereabout that sealably engage the inside surface of the internal bore 104 to seal off the side ports 108.

As noted above, the opening sleeve 110 has the first seat 120 configured to engage the first plug 30. The first seat 120 is composed of a first millable material, such as a composite material, aluminum, or other such material. By using composite materials for the seats 120, 140, the stage tool 100 can be easier to drill out by reducing protentional damage to the bit and requiring less time to drill out. However, the composite seats 120, 140 of the present disclosure to withstand loads as noted previously.

During assembly after the opening sleeve 110 has been affixed in place with the shear pins 118 and with the other sub-housing 103*b* not yet connected, the first seat 120 can be inserted into the internal passage 112 of the opening sleeve 110. The first seat 120 can engage against a wedged shoulder 114 of the sleeve 110. A seal and snap ring arrangement 115 between the sleeve 110 and the seat 120 can engage in the internal passage 112. The seating area of the seat 120 can be configured to engage a particular-sized opening plug (30).

As noted above, the closing sleeve 130 is also movably disposed in the internal bore 104 and is held in a second opened position with a second temporary connection 138, which is releasable in response to a second force. The closing sleeve 130 is initially held in a second opened position so that it does not cover the side ports 108, which permits communication between the side ports 108 and the internal bore 104 when the opening sleeve 110 is opened.

As best shown in FIG. 2B, the second temporary connection 138 can include shear pins engaged between the closing sleeve 130 and the housing's internal bore 104. During assembly before the other sub-housing 103*b* is connected, the closing sleeve 130 can be positioned in the internal bore 104 of the sub-housing 103*a*, and the shear pins 138 can be threaded through holes in the internal passage of the closing sleeve 130 to hold the sleeve 130 in place.

As noted above, the closing sleeve 130 has the second seat 140 configured to engage the second plug (40). The second seat 140 is also composed of a second millable material, preferably a composite material, although aluminum or other material could be used. During assembly after the closing sleeve 130 has been affixed in place with the shear pins 138, the second seat 140 can be inserted into the internal passage 132 of the sleeve 130. Similar to the first seat 120 and as best shown in FIG. 2B, the second seat 140 can engage against a wedged shoulder 134 of the sleeve 130. A seal and snap ring arrangement 135 between the sleeve 130 and the seat 140 can engage in the internal passage 132 of the closing sleeve 130. The seating area of the seat 140 can be configured to engage a particular-sized closing plug.

To finish the assembly, the box sub-housing 103*b* is attached to the pin sub-housing 103*a* using conventional features. The assembled tool 100 with its seats 120, 140 installed in the sleeves 110, 130 and with the sleeves 110, 130 set with preconfigured shear pins 118, 138 can now be installed on sections of casing to be run downhole.

Having an understanding of the tool 100 and its assembly, discussion turns to the use of the stage tool 100 in a cementing operation. The tool 100 assembled as in FIGS. 2A-2B is run downhole on casing 20. Then, during staged operations as shown in FIG. 3A, the first opening plug 30 is communicated down the casing string 20*b* ahead of cement. The plug 30 reaches the tool 100 and lands on the seat 120 of the opening sleeve 110. Pressure applied behind the plug 30 produces a shear force on the shear pins 118, which release in response to a predetermined shear force. The opening sleeve 110 moves from the first closed position to a first opened position, in which the sleeve 110 uncovers the side ports 108 and opens communication between the side ports 108 and the internal bore 104. The cement for the stage operation can then flow out the side ports 108 and into the annulus of the wellbore.

The opening sleeve 110 in the first opened position has a first engagement with the internal bore 104. As noted below, this first engagement, which is in the form of a tapered end of the sleeve 110 and tapered surface 105 of the bore 104 best shown in FIG. 3B, is configured to prevent rotation of the opening sleeve 110 later when milling is performed.

As best shown in the detail of FIG. 3B, the opening sleeve 110 in the first open position permits fluid communication through a bypass 109 between the sleeve 110 and the internal bore 104. In particular, the opening sleeve 110 has first and second annular seals 116*a-b* disposed externally about the sleeve's sidewall, and the internal bore 104 has first and second annular surfaces 106*a-b* having the side ports 108 therebetween. When the sleeve 110 is closed, the annular seals 116*a-b* are sealed with the annular surfaces 106*a-b*. When the sleeve 110 is opened, however, the annular seals 116*a-b* are unsealed with the annular surfaces 106*a-b*. Fluid inside the bore 104 of the housing 102 can flow into the annular bypass 109 between the sleeve 110 and internal bore 104 and can exit through relief ports 117 defined in the sleeve 110. The annular bypass 109 and relief ports 117 allow some of the fluid in the tool bore 104 to communicate around the plug 30 seated in the seat 120 so fluid can pass further downhole from the tool 100. This open fluid communication can have a number of benefits during the stage operations namely reducing chances of hydraulic locking when closing the closing sleeve 130 later during operations.

Later during the staged operations as shown in FIG. 4A, the second closing plug 40 is communicated down the casing string 20*b* behind the staged cement. The plug 40 reaches the tool 100 and lands on the second seat 140 of the closing sleeve 130. Pressure applied behind the plug 40 produces a shear force on the shear pins 138, which release in response to a predetermined shear force. The closing sleeve 130 moves from the second opened position to a second closed position, in which the sleeve 130 covers the side ports 108 and closes communication between the side ports 108 and the internal bore 104. Fluid from the stage operation can no longer flow out the side ports 108 and into the annulus of the wellbore.

The closing sleeve 130 in the second closed position has a second engagement with the opening sleeve 110. As noted below, this second engagement, which is in the form of castellations 119, 139, is configured to prevent rotation of the closing sleeve 130 during mill out.

As best shown in the detail of FIG. 4B, the closing sleeve 130 has annular seals 136*a-c* disposed externally about the sleeve's sidewall, while the internal bore 104 has annular surfaces having the side ports 108 therebetween. With the sleeve 130 in the second opened position, the annular seals 136*a-b* are unsealed with the annular surfaces. With the sleeve 130 in the second closed position, however as in FIG. 4B, the annular seals 136*a-b* are sealed with the annular surfaces on both sides of the ports 108. However, fluid inside the bore 104 of the housing 102 may still be able to flow into the annular bypass 109 between the opening sleeve 110 and internal bore 104 because its seals 116*a-b* may remain unsealed.

The closing sleeve 130 shifted closed can be locked in place. For example, the housing 102 defines an annular groove in the inner bore 104, and the sleeve 130 has a biased lock ring 137 disposed thereabout. When the sleeve 130 is moved closed, the biased lock ring 137 engages in the annular groove to lock the sleeve 130 longitudinally in the bore 104. The opening sleeve 110 is thereby locked in place as well.

As best shown in FIG. 2B, the closing sleeve 130 include a weep hole 107 defined therein and communicating the internal passage of the sleeve 130 with an annular space between the sleeve 130 and the internal bore 104 of the housing 102. The weep hole 107 can prevent hydraulic locking. When in the final closed position, the weep hole 107 may help prevent hydraulic locking between the annular seals 136*b-c*.

Once the staged operations are completed, operators can drill/mill out the seats 120, 140 and plugs 30, 40 so that the casing 20 has a near full bore through the tool 104. The plugs 30, 40 and seats 120, 140 (composed of composite material) can be drilled/milled out, as shown in FIG. 5. During the drilling/milling process, the sleeves 110 and 130 are prevented from rotating so a drill/mill head can more efficiently remove the seats 120, 140 and plugs 30, 40. For the opening sleeve 110 as noted previously, a tapered end disposed on the sleeve 110 engages/wedges in a tapered surface 105 of the internal bore 104 to lock the sleeve 110 and keep it from rotating. First castellations 119 defined on the other end of the sleeve 110 can engage in second castellations 139 defined on the end of the closing sleeve 130, which prevents the closing sleeve 130 from rotating.

Figure 6:
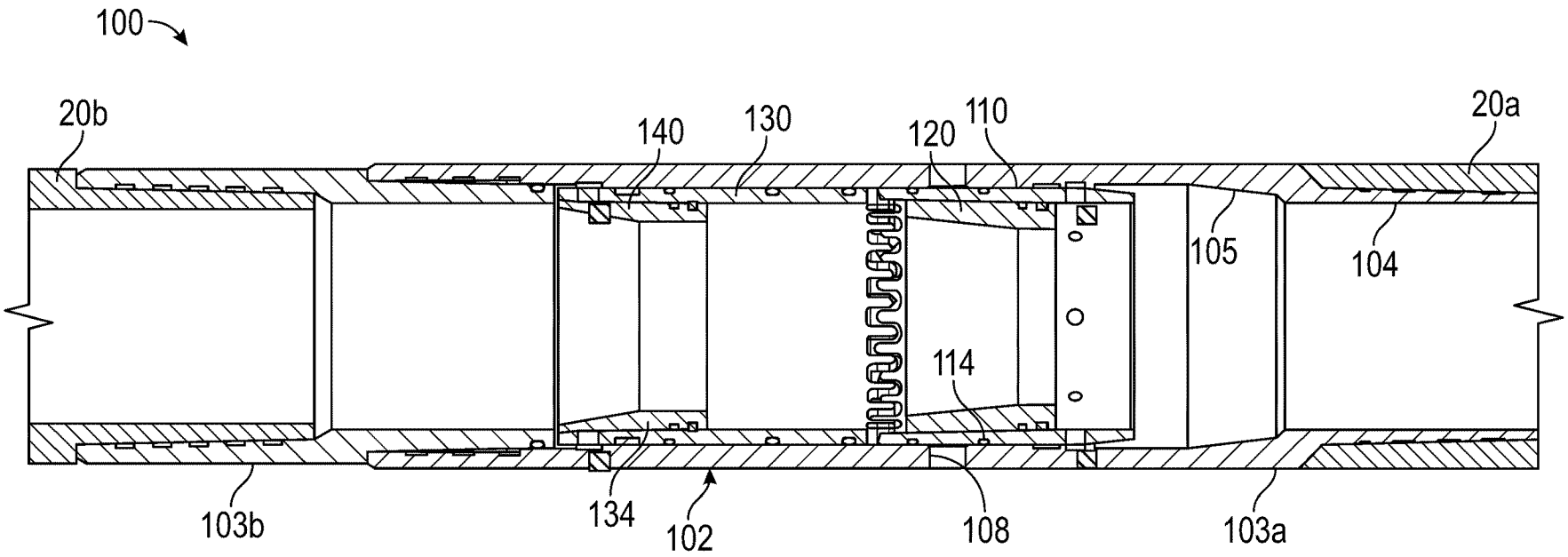
FIG. 6 illustrates a cross-sectional view of the stage tool having a different configuration.

FIG. 6 illustrates a cross-sectional view of a stage tool 100 having a slightly different configuration. In this configuration, the same reference numerals are used for comparable components as disclosed in the previous embodiment of FIGS. 2A through 5. As can be seen in this example, the seats 120, 140 position in wedged shoulders of the internal passages 112, 132 of the sleeves 110, 130. Seals and lock rings are used as before. The opening sleeve 110 still includes a tapered end to engage a taper 105 in the bore 104, and both of the sleeves 110, 130 have castellations 119, 139. The opening sleeve 110 in the opened condition (not shown) can still provide the annular bypass 109 as before. In contrast to the previous configurations, more castellations 119, 139 with greater contrast are merely used. Overall, the stage tool 100 of FIG. 6 can operate in a comparable manner to the stage tool 100 discussed previously with respect to FIGS. 2A through 5.

Figure 7A:
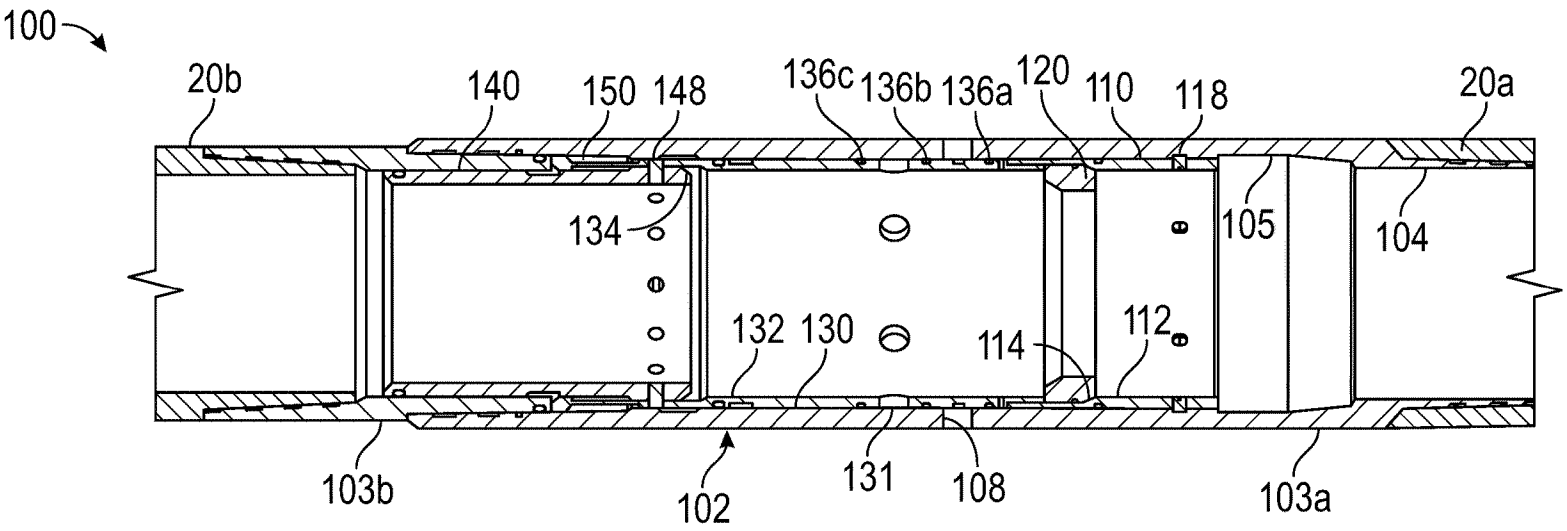
FIG. 7A illustrates a cross-sectional view of a second stage tool of the present disclosure in an initial closed condition.
Figure 7B:
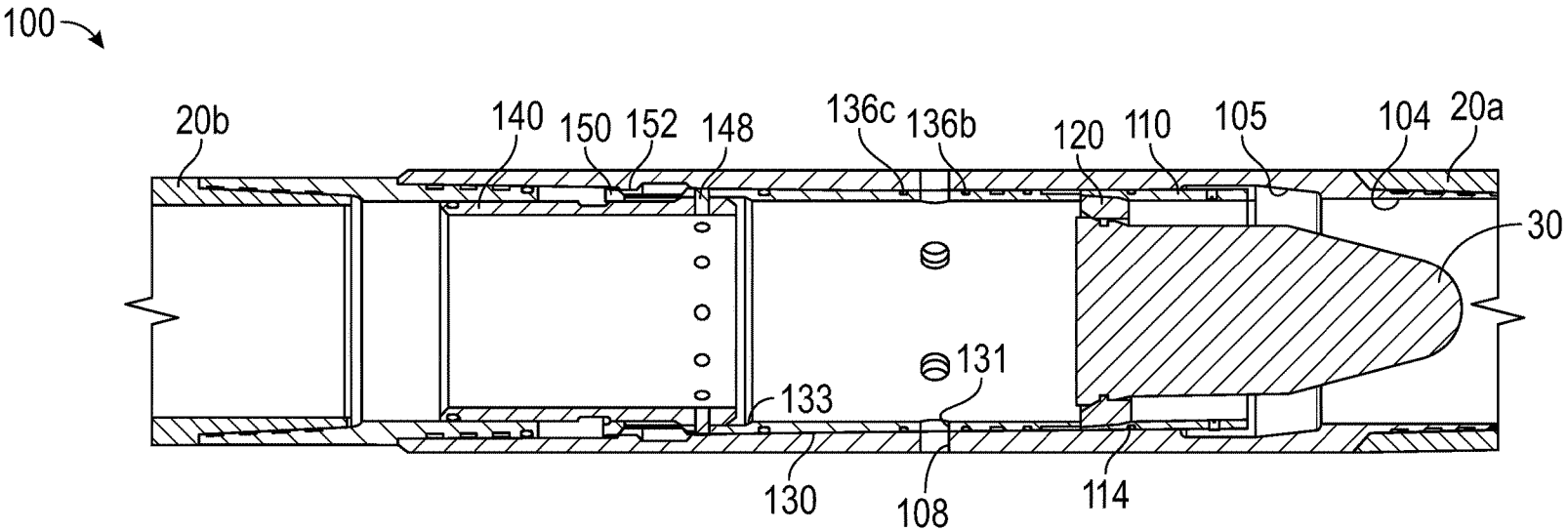
FIG. 7B illustrates a cross-sectional view of the stage tool in an opened condition.

FIGS. 7A-7B illustrate cross-sectional views of a second stage tool 100 of the present disclosure. In this stage tool 100, the same reference numerals are used for comparable components as disclosed in the previous embodiment of FIGS. 2A through 6. In FIG. 7A, the stage tool 100 is shown in an initial closed condition for run-in downhole. In FIG.

Figure 7C:
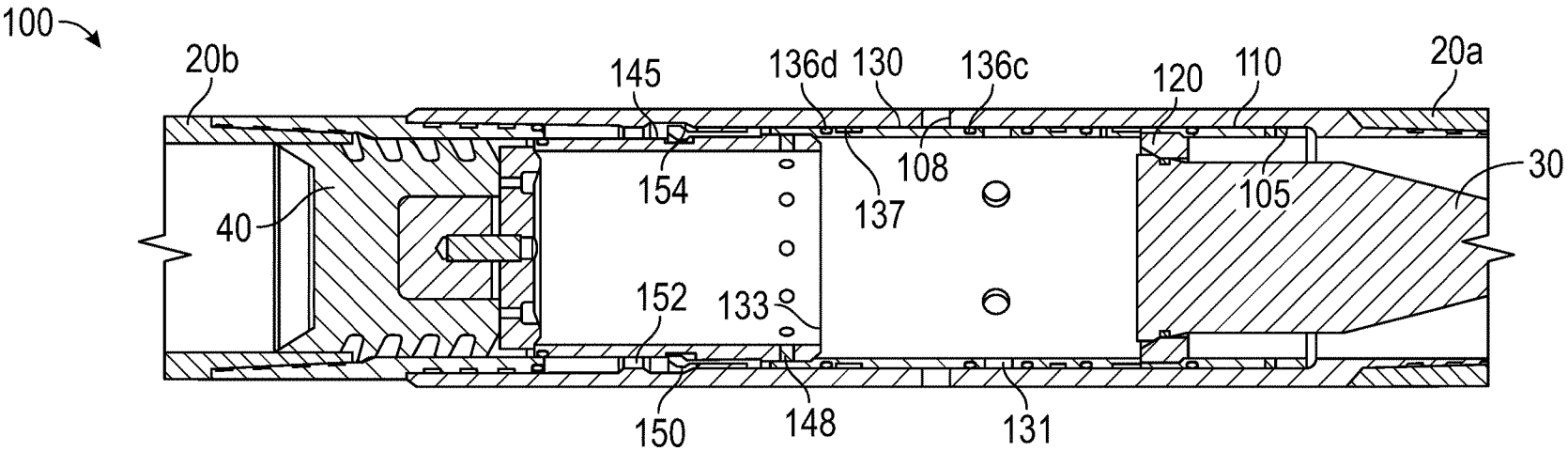
FIG. 7C illustrates a cross-sectional view of the stage tool in a final closed condition.
Figure 7D:
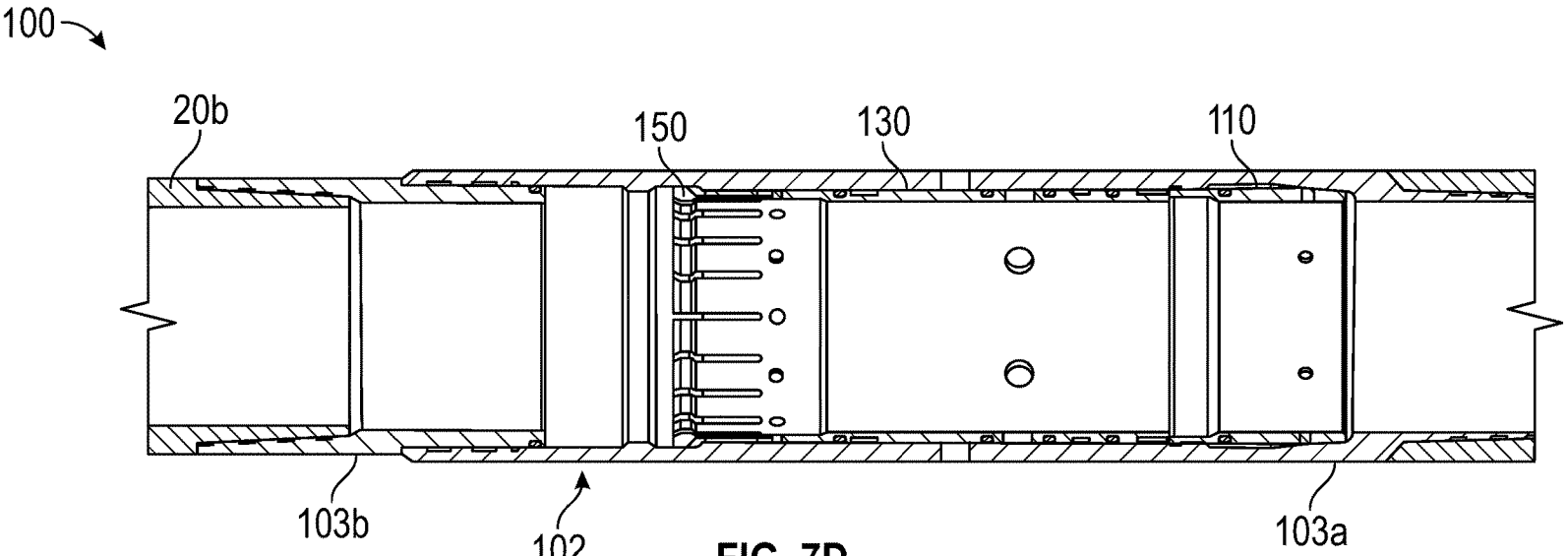
FIG. 7D illustrates a cross-sectional view of the stage tool having the seats milled out.

7B, a first opening plug 30 is used to open the tool 100, while a second closing plug 40 in FIG. 7C is used to close the tool 100. Finally as shown in FIG. 7D, seats 120, 140 and the plugs 30, 40 are milled out of the tool 100 after cementing operations are completed.

Again, the stage tool 100 includes a housing 102 having an internal bore 104 and defining one or more side ports 108 that communicate the internal bore 104 with the wellbore. As before, the housing 102 has a simplified configuration that includes a pin sub-housing 103*a* and a box sub-housing 103*b*. The pin sub-housing 103*a* has a pin end for connecting to other tubulars, such as a casing section 20*a*, while the box sub-housing 103*b* has a box end connecting to other tubulars, such as a casing section 20*b*. Connection ends of these sub-housings 103*a-b* couple together to complete the housing 102. This facilitates assembly of the tool 100 so that a number of conventional housing features are not needed.

The stage tool 100 includes a first opening sleeve 110 and a second closing sleeve 130. In contrast to the previous configurations, the two sleeves 110, 130 are connected to one another so that the two sleeves 110, 130 are movable together in the internal bore 104. In particular, an uphole end of the lower sleeve 110 is affixed to a downhole end of the upper sleeve 130. Preferably, this connection is made using wire at the thin ends of the sleeves 110 and 130, although other techniques can be used.

The opening sleeve 110 is movably disposed in the internal bore 104 and held in a first closed position (FIG. 7A) with a first temporary connection 118, which is releasable in response to a first force. As shown, the first temporary connection 118 includes shear pins engaged between the opening sleeve 110 and the housing's internal bore 104. During assembly, the opening sleeve 110 can be positioned in the housing's internal bore 104 of the sub-housing 103*a* while the other sub-housing 103*b* is not connected, and the shear pins 118 can be threaded through holes in the internal passage of the opening sleeve 110 to hold the sleeve 110 in place.

The opening sleeve 110 is initially held in the first closed position (FIG. 7A) so that the side ports 108 are covered by the connected closing sleeve 130 to close communication between the side ports 108 and the internal bore 104. The opening sleeve 110 has a first seat 120 configured to engage the first plug 30 (FIG. 7B). The first seat 120 is composed of a first millable material, preferably a composite material, although aluminum or other material could be used. During assembly after the opening sleeve 110 has been affixed in place with the shear pins, the first seat 120 can be inserted into the internal passage 112 of the opening sleeve 110. The first seat 120 can engage against a wedged shoulder 114 of the sleeve 110. A seal and snap ring on the seat 120 can engage in the internal passage 112 of the sleeve 110.

The closing sleeve 130 is also movably disposed in the internal bore 104. Connected to the opening sleeve 110, the closing sleeve 130 is also initially held in a closed position (FIG. 7A). During assembly, the closing sleeve 130 can be positioned in the housing's internal bore 104 of the sub-housing 103*a* while the other sub-housing 103*b* is not connected.

The closing sleeve 130 initially held in the closed position covers the side ports 108 and closes communication between the side ports 108 and the internal bore 104. The closing sleeve 130 has a second seat 140 configured to engage the second plug (40: FIG. 7C). The second seat 120 is also composed of a second millable material, preferably a composite material, although aluminum or other material can be used. During assembly after the opening and closing sleeves 110, 130 have been affixed in place with the shear pins 118, the second seat 140 can be inserted into the internal passage 132 of the sleeve 130. The second seat 140 can engage against a wedged shoulder 134 of the sleeve 130. Shear pins 148 on the seat 140 can then be engaged with the closing sleeve 130.

Stage operations follow comparable steps to those outlined previously. As shown in FIG. 7B, an opening plug 30 is conveyed down ahead of staged cement (not shown). The plug 30 reaches the seat 120 of the opening sleeve 110. Pressure applied behind the plug 30 produces a shear force on the shear pins 118, which release in response to a predetermined shear force. The opening sleeve 110 moves and the connected closing sleeve 130 moves with it from the first closed position to a first opened position, in which the sleeve 130 uncovers the side ports 108 and opens communication between the side ports 108 and the internal bore 104.

As shown, the closing sleeve 130 defines ports 131 therein communicating an internal passage 132 of the sleeve 130 with an annular space between the sleeve 130 and the internal bore 104. Initially, the ports 131 on the sleeve 130 with the tool 100 closed are unaligned with the side ports 108 of the housing 102. When the opening plug 30 has been deployed to shift the tool 100 open, the ports 131 on the sleeve 130 are aligned with the side ports 108 to allow for fluid communication. The cement for the stage operation can then flow out the sleeve's ports 131 and aligned side ports 108 and can flow into the annulus of the wellbore.

Depending on the implementation, the opening sleeve 110 in the first open position may or may not permit fluid communication through a bypass between the sleeve 110 and the internal bore 104. As best shown in the detail of FIG. 7B, the opening sleeve 110 has an annular seal 116 disposed thereabout that engages the internal bore 104. The closing sleeve 130 has first and second annular seals 136*b-c* having the ports 131 therebetween. When the closing sleeve 130 is closed as in FIG. 7A, the annular seals 136*a-b* are sealed with the internal bore 104 on both sides of the housing's side ports 108. When the sleeve 130 is opened as in FIG. 7B, however, the annular seals 136*b-c* are instead sealed with the internal bore 104 on both sides of the side ports 108. Fluid inside the bore 104 of the housing 102 can flow through the aligned ports 131 and 108.

Later during the staged operations as shown in FIG. 7C, a second closing plug 40 is communicated down the casing string behind the cement. The plug 40 reaches the tool 100 and lands on the seat 140 of the closing sleeve 130. As shown here, the second seat 140 has shear connection (e.g., shear pins 148) to the closing sleeve 130, and the closing sleeve 130 includes a second temporary connection 150 in the form of a collet configured to engage a shoulder 152 in the internal bore 104 of the housing 102.

Pressure applied behind the plug 40 produces a force on the shear pins 148, which release and allow the seat 140 to shoulder against a shoulder 133 on the closing sleeve 130. A groove 145 on the seat 140 now frees the fingers on the collet 150 so that they can retract, and the fingers on the collet 150 releases past a shoulder 152 to another recess 154 in response to a predetermined force. The closing sleeve 130 moves from the opened position to a closed position, in which the sleeve 130 covers the side ports 108 and closes communication between the side ports 108 and the internal bore 104. In other words, the ports 131 in the sleeve 130 become unaligned with the housing's side ports 108, and the seals 136*c-d* on the sleeve 130 seal inside the bore 104 on both sides of the side ports 108. Fluid from the stage operation can no longer flow out the side ports 108 and into the annulus of the wellbore.

As best shown in the detail of FIG. 7C, the closing sleeve 130 has annular seals 136*a-d* disposed thereabout, while the internal bore 104 has annular surfaces having the side ports 108 therebetween. With the sleeve 130 in the run-in position as in FIG. 7A, the annular seals 136*a-b* are sealed with the annular surfaces. With the sleeve 130 in the open position as in FIG. 7B, the annular seals 136*b-c* are sealed with the annular surfaces. When the sleeve 130 is in the closed position as shown in FIG. 7C, however, the annular seals 136*c-d* are sealed with the annular surfaces.

The closing sleeve 130 shifted closed can be locked in place. For example, the housing 102 defines an annular groove in the inner bore 104, and the sleeve 130 has a biased lock ring 137 disposed thereabout. When the sleeve 130 is moved closed, the biased lock ring 137 engages in the annular groove to lock the sleeve 130 longitudinally in the bore 104.

For its part, the opening sleeve 110 in the closed position has an engagement with the internal bore 104. As before, for example, this first engagement includes a tapered end of the sleeve 110 engaged/wedged in the taper 105 of the internal bore 104. This engagement can prevent rotation of the sleeves 110, 130 as noted below.

Once the staged operations are completed, operators can drill/mill out the seats 120, 140 and plugs 30, 40 so that the casing string 20*a-b* has a near full bore through the tool 104. The plugs 30, 40 and the seats 120, 140 being composed of millable material can be drilled/milled out, as shown in FIG. 7D. During the drilling/milling process, the sleeves 110 and 130 are prevented from rotating using the tapered engagement so a drill/mill head can more efficiently remove the seats 120, 140 and plugs 30, 40.

Figure 8A:
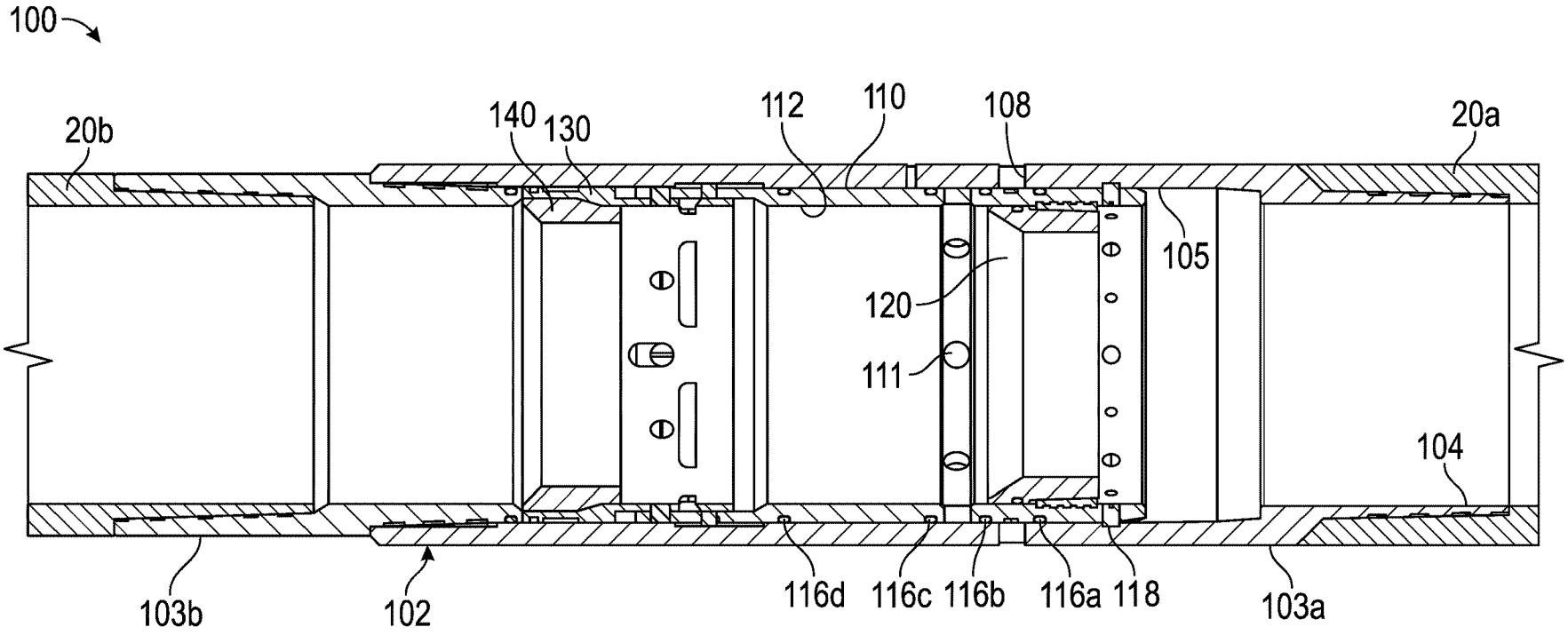
FIG. 8A illustrates a cross-sectional view of a third stage tool of the present disclosure in an initial closed condition.
Figure 8B:
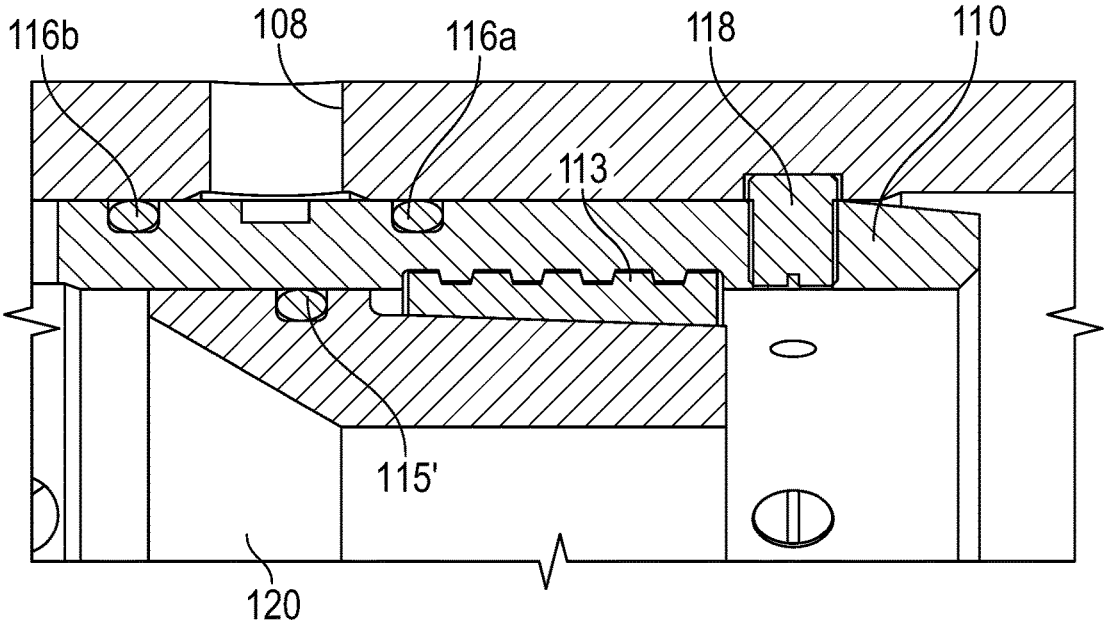
FIGS. 8B-8C illustrate details of FIG. 8A.
Figure 8C:
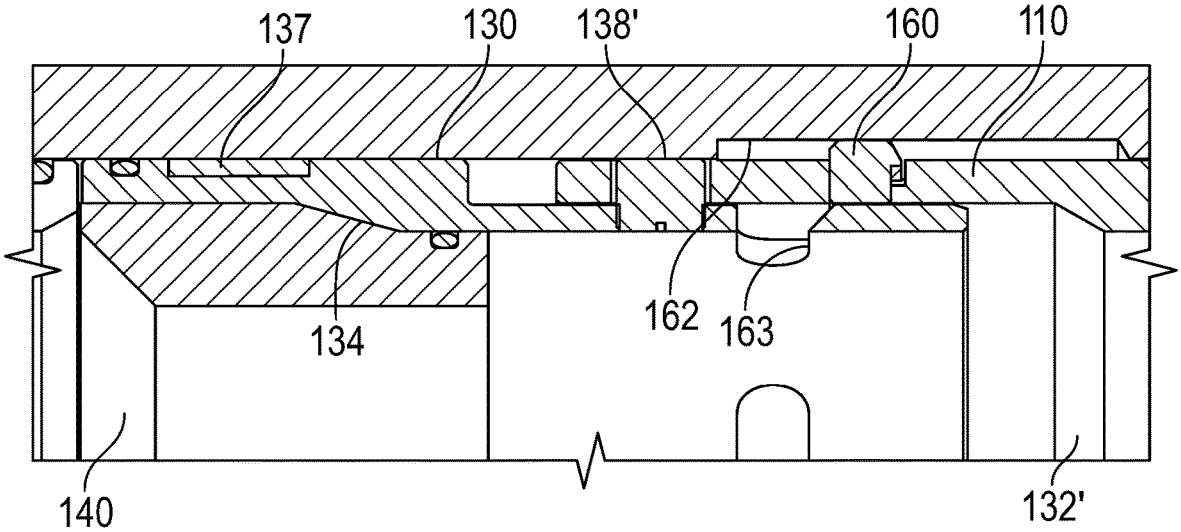
Figure 9A:
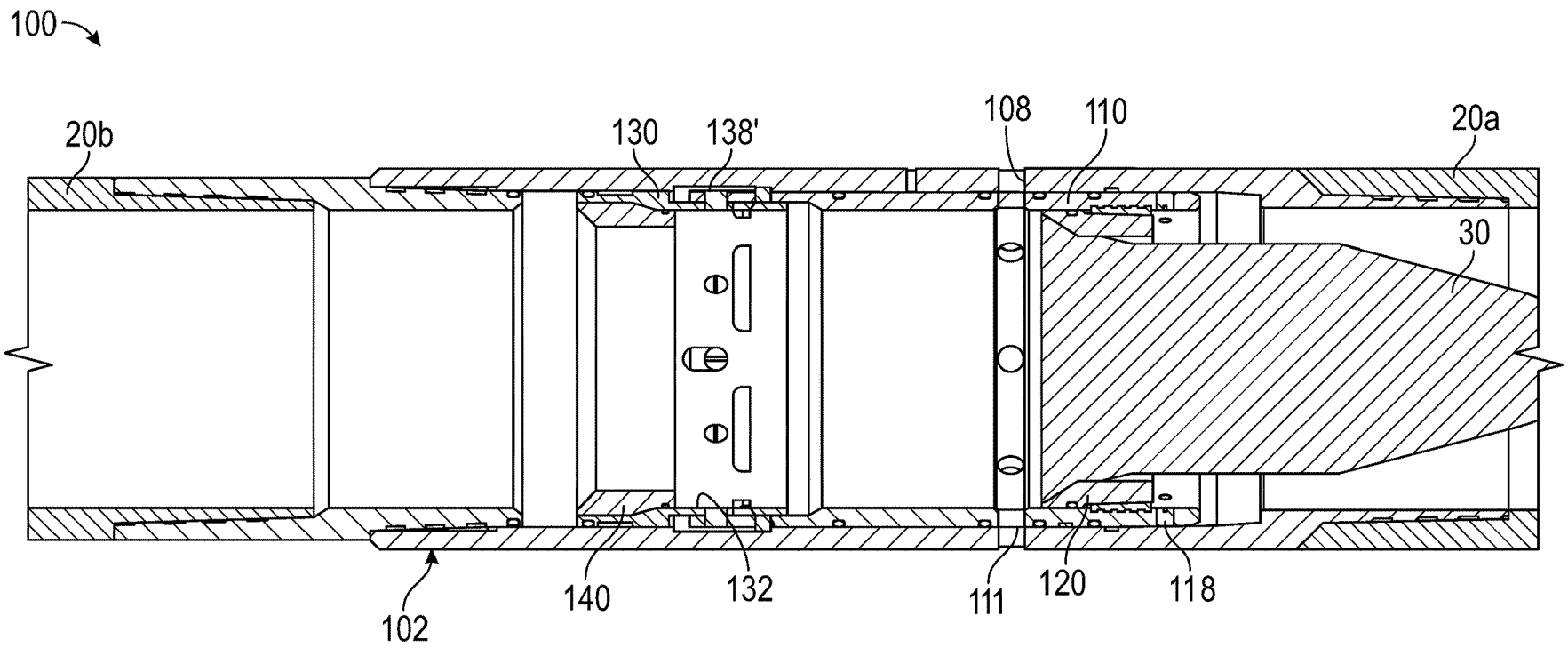
FIG. 9A illustrates a cross-sectional view of the stage tool in an opened condition.
Figure 9B:
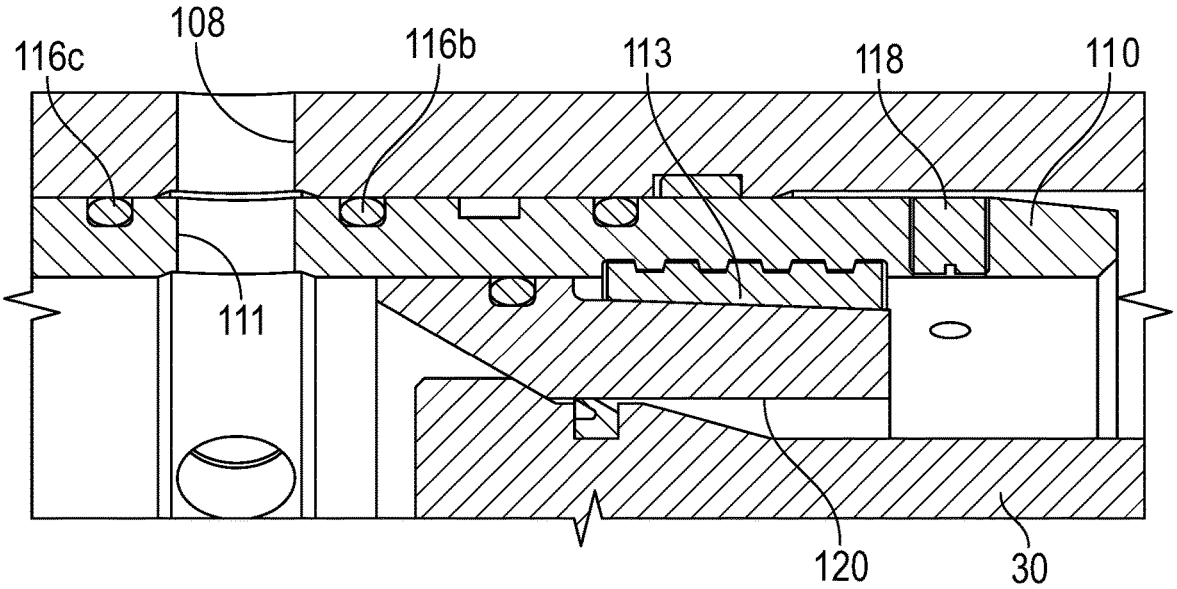
FIGS. 9B-9C illustrate details of FIG. 9A.
Figure 9C:
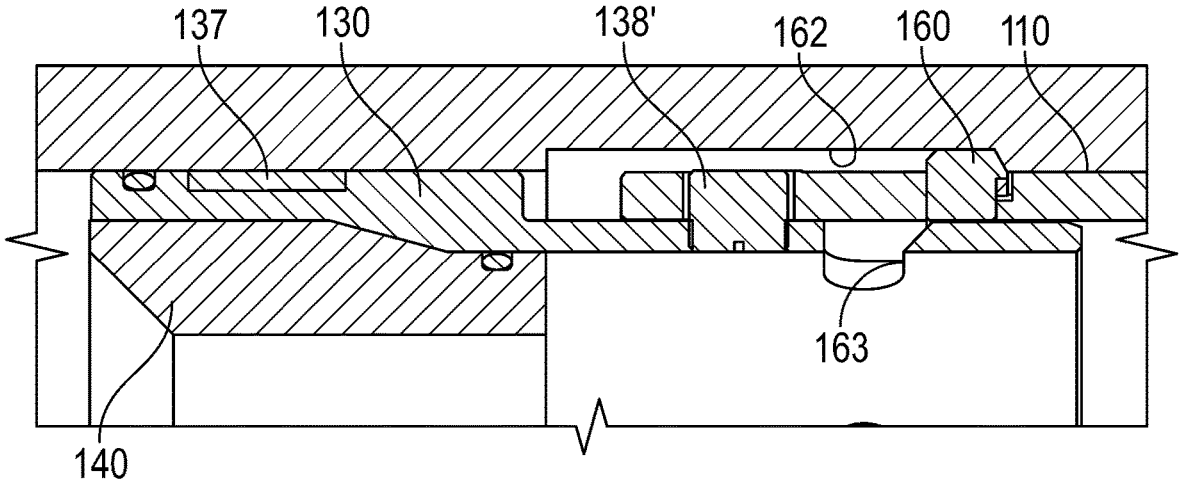
Figure 10:
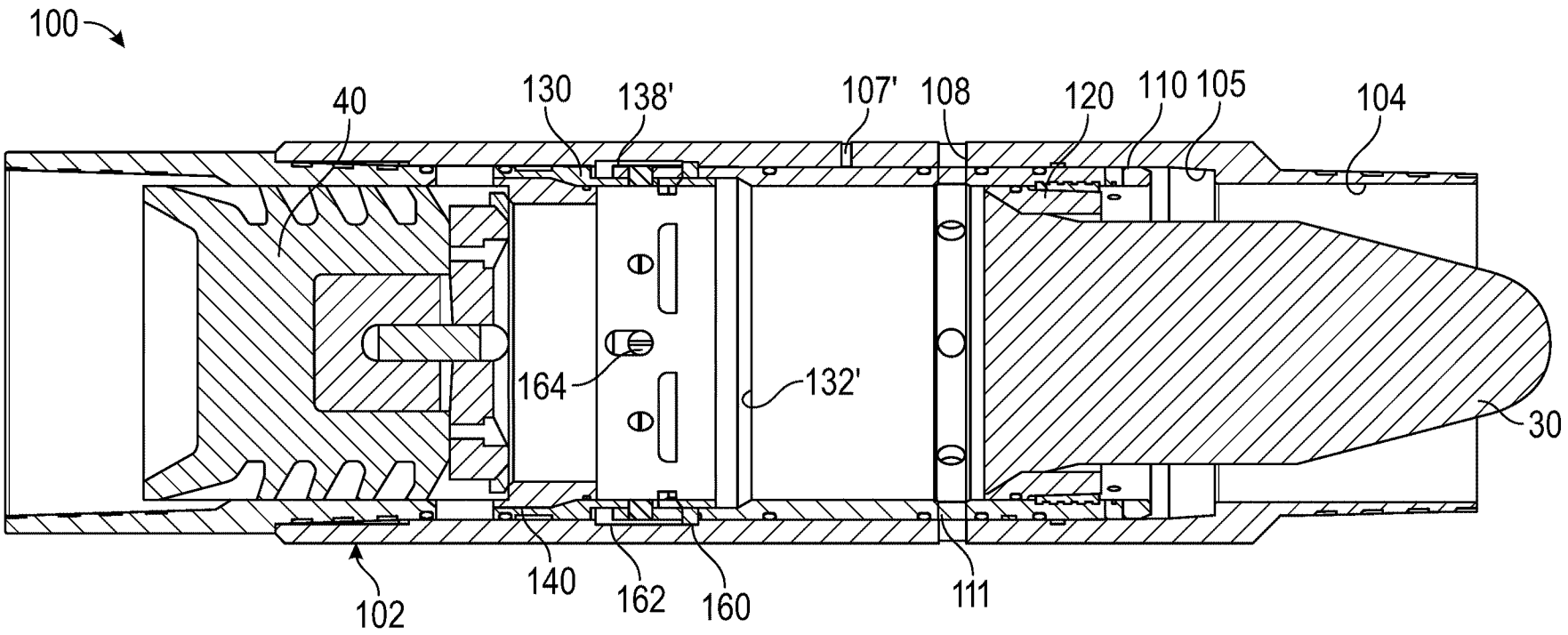
FIG. 10 illustrates a cross-sectional view of the stage tool in a final closed condition.
Figure 11:
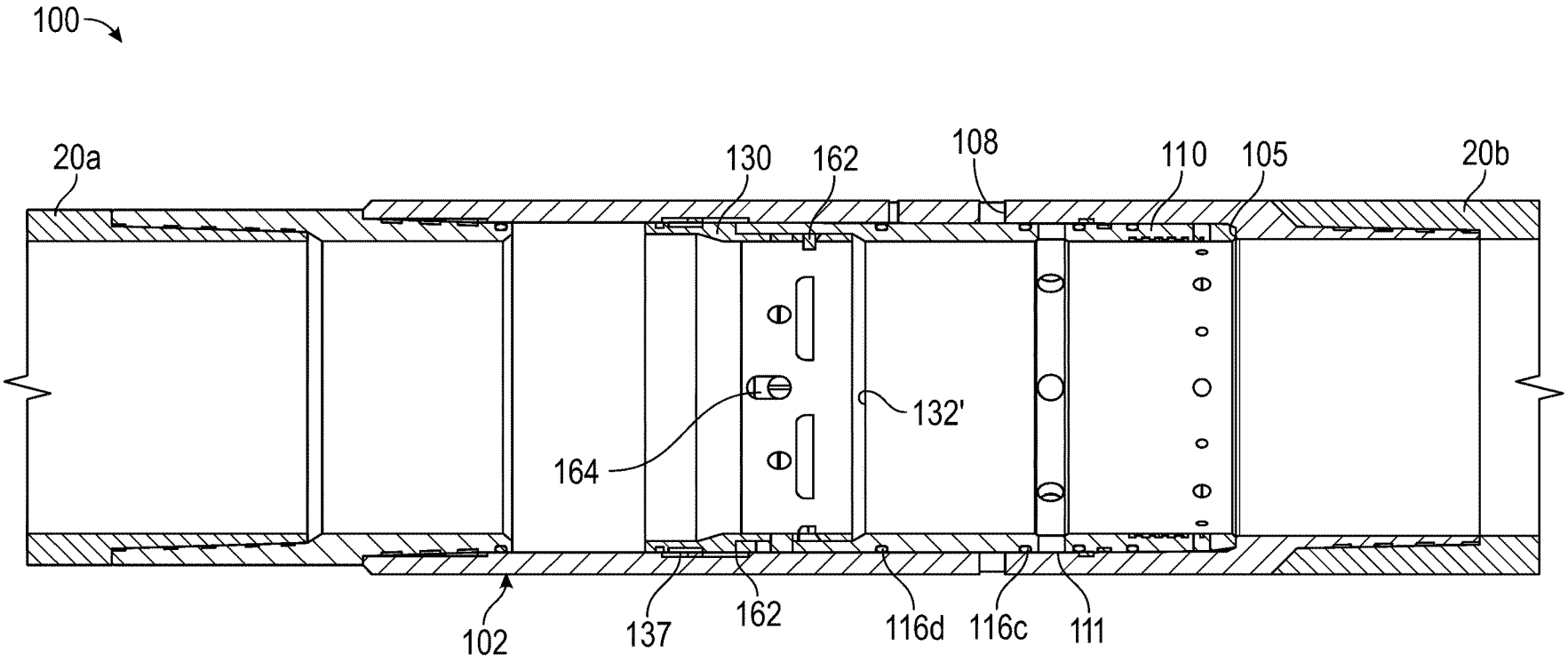
FIG. 11 illustrates a cross-sectional view of the stage tool having the seats and plugs milled out.

FIGS. 8A through 11 illustrate cross-sectional views of a third stage tool 100 according to the present disclosure. When used, the tool 100 is connected to sections 20*a-b* of casing string at each end. In this tool 100, the same reference numerals are used for comparable components as disclosed in the previous embodiment of FIGS. 2A through 7D. In FIG. 8A, the stage tool 100 is shown in an initial closed condition for run-in downhole. In FIG. 9A, a first opening plug 30 is used to open the tool 100, while a second closing plug 40 in FIG. 10 is used to close the tool 100. Finally as shown in FIG. 11, seats 120, 140 and the plugs 30, 40 are milled out of the tool 100 after cementing operations are completed.

Again, the stage tool 100 includes a housing 102 having an internal bore 104. One or more side ports 108 on the side of the housing 102 can communicate the internal bore 104 with the wellbore annulus (not shown) depending on the locations of an opening sleeve 110 and a closing sleeve 130 on the tool 100.

The housing 102 has a simplified configuration that includes only two subcomponents, namely a pin sub-housing 103*a* and a box sub-housing 103*b*. The pin sub-housing 103*a* has a pin end for connecting to other tubulars, such as casing 20*a*, while the box sub-housing 103*b* has a box end connecting to other tubulars, such as casing 20*b*. Connection ends of these sub-housings 103*a-b* couple together to complete the housing 102 of the tool 100. This configuration facilitates assembly of the tool 100 so that a number of conventional housing features, such as three or more housing components, lock nuts, additional housing seals, etc., are not needed.

As shown in FIG. 8A, the stage tool 100 includes a first, opening sleeve 110 and a second, closing sleeve 130. In the present configuration, the two sleeves 110, 130 are movably connected to one another so that the opening sleeve 110 and the closing sleeve 130 can first move together in the internal bore 104 and the closing sleeve 130 can then move separately on the opening sleeve 110.

The opening sleeve 110 is movably disposed in the internal bore 104 and is held in a first closed position (FIG. 8A) with a first temporary connection 118, which is releasable in response to a first force. As best shown in FIG. 8B, the first temporary connection 118 includes shear pins engaged between the opening sleeve 110 and the housing's internal bore 104. During assembly, the opening sleeve 110 can be positioned in the housing's internal bore 104 of the sub-housing 103*a* while the other sub-housing 103*b* is not yet connected. The shear pins 118 can be threaded through holes in the internal passage 112 of the opening sleeve 110 to hold the sleeve 110 in place.

The opening sleeve 110 is initially held in a first closed position that covers the side ports 108 and closes communication between the side ports 108 and the internal bore 104. In particular, a sidewall of the opening sleeve 110 has seals 116*a-d* disposed externally thereabout that sealably engage the inside surface of the internal bore 104 to seal off the side ports 108. For instance, seals 116*a-b* can sealably engage when the sleeve 110 is in the first closed position, seals 116*b-c* can sealably engage when the sleeve 110 is in the opened position, and seals 116*c-d* can sealably engage when the sleeve 110 is in the second closed position, The opening sleeve 110 has a first seat 120 configured to engage the first plug 30. The first seat 120 is composed of a first millable material, preferably a composite material, although aluminum or other material could be used. During assembly after the opening sleeve 110 has been affixed in place with the shear pins 118 and with the other sub-housing 103*b* not yet connected, the first seat 120 can be inserted into the internal passage of the opening sleeve 110. Again, the first seat 120 can engage a tapered shoulder in the inner passage 112 of the first sleeve 110. In contrast to previous configurations wherein the tapered shoulder is integral with the inner passage 112, the first seat 120 shown here can engage against a wedged retainer 113 disposed in the sleeve 110. This wedged retainer 113, which can be composed of aluminum, has external teeth to engage grooves inside the sleeve 110 and has a wedged surface against which the seat 120 positions. A seal 115' on the seat 120 can engage in the internal passage 112. The seating area of the seat 120 can be configured to engage a particular-sized opening plug (30).

The closing sleeve 130 is connected to the opening sleeve 110 and is held in position with a second temporary connection 138', which is releasable in response to a second force. As best shown in FIG. 8C, the second temporary connection 138' can include shear pins engaged between the closing sleeve 130 and the opening sleeve 110. As also shown in FIG. 8C, the opening sleeve 110 includes another temporary connection engaged in the internal bore 104 of the housing. Here, movable lock dogs 160 disposed in the opening sleeve 110 engage in an annular groove 162 of the housing's bore 104. Operation of the movable lock dogs 160 is discussed below.

During assembly before the other sub-housing 103*b* is connected, the movable lock dogs 160 can be positioned in the opening sleeve 110 to engage in the annular groove 162. The closing sleeve 130 can be positioned in the internal passage 110 of the opening sleeve 110 to cover the ends of the movable lock dogs 160, and the shear pins 138' can be threaded through holes in the internal passage of the closing sleeve 130 to hold the sleeve 130 in place.

As noted above, the closing sleeve 130 has the second seat 140 configured to engage the second plug (40). The second seat 120 is also composed of a second millable material, preferably a composite material, although aluminum or other material can be used. During assembly after the closing sleeve 130 has been affixed in place with the shear pins 138', the second seat 140 can be inserted into the internal passage 132 of the sleeve 130. The second seat 140 can engage against a shoulder 134 of the sleeve 130. A seal and snap ring arrangement (not shown) on the seat 140 can engage in the internal passage 132 of the closing sleeve 130. The seating area of the seat 140 can be configured to engage a particular-sized closing plug.

The stage tool 100 assembled as in FIGS. 8A-8C is run downhole on casing 20. Then, during staged operations as shown in FIG. 9A, a first opening plug 30 is communicated down the casing 20*b* ahead of cement. The plug 30 reaches the tool 100 and lands on the seat 120 of the opening sleeve 110. Pressure applied behind the plug 30 produces a shear force on the shear pins 118, which release in response to a predetermined shear force. The opening sleeve 110 moves from the first closed position to a first opened position, in which the sleeve 110 uncovers the side ports 108 and opens communication between the side ports 108 and the internal bore 104. In other words, the ports 111 in the sleeve 110 initially unaligned with the housing's side ports 108 are moved into alignment with the side ports 108. The cement for the stage operation can then flow out the side ports 108 and into the annulus of the wellbore.

The opening sleeve 110 in the first opened position does not yet lock in engagement with the internal bore 104. As noted below, this first engagement, which is in the form of a tapered end of the sleeve 110 and taper 105 of the bore 104, is configured to prevent rotation of the opening sleeve 110 later when milling is performed.

As best shown in the detail of FIG. 9B, the opening sleeve 110 in the first open position permits fluid communication through the aligned ports 111 and 108. In particular, the opening sleeve 110 has annular seals 116*b-c* disposed externally about the sleeve's sidewall that can seal with the internal surface of the internal bore 104 on both sides of the side ports 108 therebetween.

As shown in FIG. 9C, the opening sleeve 110 shifted to its open position is stopped by engagement of the movable lock dogs 160 against the edge of the annular groove 162 of the internal bore 104. This keeps the sleeve 110 in the open position until the closing plug (40) is deployed.

Later during the staged operations as shown in FIG. 10, the second closing plug 40 is communicated down the casing 20*b* behind the staged cement. The plug 40 reaches the tool 100 and lands on the second seat 140 of the closing sleeve 130. Pressure applied behind the plug 40 produces a shear force on the shear pins 138', which release in response to a predetermined shear force. The closing sleeve 130 shifts on the opening sleeve 110 so that the support behind the movable lock dogs 160 is removed.

In particular, the openings 163 in the closing sleeve 130 are shifted behind the lock dogs 160. This allows the lock dogs 160 to disengage from the annular groove 162. The closing sleeve 130 can then shift and engage a shoulder 132' inside the opening sleeve 110. Continued pressure then shifts the opening sleeve 110 to move from the second opened position to a second closed position, in which the sleeve 110 covers the side ports 108 and closes communication between the side ports 108 and the internal bore 104. In other words, the ports 111 in the sleeve 110 become unaligned with the housing's side ports 108. Fluid from the stage operation can no longer flow out the side ports 108 and into the annulus of the wellbore.

The closing sleeve 130 in the second closed position has a second engagement with the opening sleeve 110. As noted below, this second engagement, which is in the form of slotted pins 164, is configured to prevent rotation of the closing sleeve 130 during milling out.

As best shown in FIG. 11, the opening sleeve 130 has an additional annular seal 116*d* disposed externally about the sleeve's sidewall. With the sleeve 110 shifted in the second opened position, the annular seals 116*c-d* are sealed with the internal bore 104 to close off communication with the housing's side ports 108. Finally, the closing sleeve 130 shifted on the opening sleeve 110 can be locked in place using a lock ring 137 in the exposed slots. The lock ring 137 as further shown in FIG. 11 locks into the groove 162 when the sleeve 130 is in the second closed position.

As best shown in FIG. 10, the housing 102 include a weep hole 107' defined therein and communicating with the internal bore 104 of the housing 102. The weep hole 103 can help prevent hydraulic locking of the sleeve 110.

Once the staged operations are completed, operators can drill/mill out the seats 120, 140 and plugs 30, 40 so that the casing 20*a-b* has a near full bore through the stage tool 100. The plugs 30, 40 and seats 120, 140 being composed of millable material can be drilled/milled out, as shown in FIG. 11. During the drilling/milling process, the sleeves 110 and 130 are prevented from rotating so a drill/mill head can more efficiently remove the seats 120, 140 and plugs 30, 40. For the opening sleeve 110 as noted previously, a tapered end disposed on the sleeve 110 engages/wedges in the tapered surface 105 of the internal bore 104 to lock the sleeve 110 and keep it from rotating. The slotted pin(s) 164 between the sleeves 110, 130 prevent the closing sleeve 130 from rotating.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A stage tool used in a wellbore and being opened with a first plug and being closed with a second plug, the stage tool comprising:

a housing having an internal bore and defining a side port, the side port communicating the internal bore with the wellbore;

a first sleeve movably disposed in the internal bore and being held in a first closed position with a first temporary connection, the first temporary connection being releasable in response to a first force, the first sleeve in the first closed position closing communication between the side port and the internal bore, the first sleeve having a first seat disposed therein, the first seat being configured to engage the first plug and being composed of a first millable material, the first seat being engaged against a tapered shoulder in an internal passage of the first sleeve, the first seat having a seal sealed against the internal passage and having a snap ring engaged in an inner groove of the internal passage, the first sleeve in response to release of the first temporary connection due to the first force being movable from the first closed position to a first opened position, the first sleeve in the first opened position opening communication between the side port and the internal bore, the first sleeve in a final position in the bore having a first engagement with the internal bore configured to prevent rotation of the first sleeve; and a second sleeve movably disposed in the internal bore and held with a second temporary connection, the second temporary connection being releasable in response to a second force, the second sleeve in a second opened position opening communication between the side port and the internal bore, the second sleeve having a second seat disposed therein, the second seat being configured to engage the second plug and being composed of a second millable material, the second sleeve in response to release of the second temporary connection due to the second force being movable from the second opened position to a second closed position, the second sleeve in the second closed position closing communication between the side port and the internal bore, the second sleeve in the second closed position having a second engagement with the first sleeve configured to prevent rotation of the second sleeve.

2. The stage tool of claim 1, wherein the first sleeve comprises a bypass being opened with the first sleeve in the first open position and permitting fluid communication between opposing sides of the first seat.

3. The stage tool of claim 2, wherein the first sleeve comprises a sidewall having first and second annular seals disposed externally thereabout, the internal bore having first and second annular surfaces having the side port therebetween, the first and second annular seals with the first sleeve in the first closed position being sealed with the first and second annular surfaces, the first and second annular seals with the first sleeve in the first opened position being unsealed with the first and second annular surfaces, the first sleeve having a port therein, the port communicating an annular space as the bypass between the first sleeve and the internal bore with an internal passage of the first sleeve.

4. The stage tool of claim 1, wherein the first and second millable materials each comprises a composite material; and wherein the housing, the first sleeve, and the second sleeve are each composed of a metal material.

5. The stage tool of claim 1, wherein the second sleeve comprises a sidewall having first and second annular seals disposed externally thereabout, the internal bore having first and second annular surfaces having the side port therebetween, the first and second annular seals with the first sleeve in the second opened position being unsealed with the first and second annular surfaces, the first and second annular seals with the second sleeve in the second closed position being sealed with the first and second annular surfaces.

6. The stage tool of claim 1, wherein the second seat is engaged against a tapered shoulder in an inner passage of the second sleeve, the second seat having a seal sealed against the internal passage and having a snap ring engaged in an inner groove of the internal passage.

7. The stage tool of claim 1, wherein the housing defines an annular groove in the internal bore; and wherein the second sleeve comprises a biased ring disposed thereabout, the biased ring with the second sleeve in the second closed condition being configured to engage in the annular groove.

8. The stage tool of claim 1, wherein the first temporary connection comprises a first shear pin engaged between the first sleeve and the internal bore of the housing; and wherein the second temporary connection comprises a second shear pin engaged between the second sleeve and the internal bore of the housing.

9. The stage tool of claim 1, wherein the housing comprises a first sub-housing having a pin end and a first connection end; and a second sub-housing having a box end and a second connection end, the first and second connection ends coupled together, the first sleeve and the second sleeve being assembled in the first sub-housing.

10. The stage tool of claim 1, wherein the first engagement comprises a tapered end disposed on the first sleeve and being engageable in a tapered surface of the internal bore; and wherein the second engagement comprises first castellations defined on a first end of the first sleeve and second castellations defined on a second end of the second sleeve, the first and second castellations being engageable with one another.

11. The stage tool of claim 1, wherein the first and second sleeves are unconnected, the first sleeve being separately movable in the internal bore relative the second sleeve.

12. A stage tool used in a wellbore and being opened with a first plug and being closed with a second plug, the stage tool comprising:

a housing having an internal bore and defining a side port, the side port communicating the internal bore with the wellbore;

a first sleeve movably disposed in the internal bore and being held in a first closed position with a first temporary connection, the first temporary connection being releasable in response to a first force, the first sleeve in the first closed position closing communication between the side port and the internal bore, the first sleeve having a first seat disposed therein, the first seat being configured to engage the first plug and being composed of a first millable material, the first sleeve in response to release of the first temporary connection due to the first force being movable from the first closed position to a first opened position, the first sleeve in the first opened position opening communication between the side port and the internal bore, the first sleeve in a final position in the bore having a first engagement with the internal bore configured to prevent rotation of the first sleeve; and a second sleeve movably disposed in the internal bore and held with a second temporary connection, the second temporary connection being releasable in response to a second force, the second sleeve in a second opened position opening communication between the side port and the internal bore, the second sleeve having a second seat disposed therein, the second seat being engaged against a tapered shoulder in an internal passage of the second sleeve, the second seat having a seal sealed against the internal passage and having a snap ring engaged in an inner groove of the internal passage, the second seat being configured to engage the second plug and being composed of a second millable material, the second sleeve in response to release of the second temporary connection due to the second force being movable from the second opened position to a second closed position, the second sleeve in the second closed position closing communication between the side port and the internal bore, the second sleeve in the second closed position having a second engagement with the first sleeve configured to prevent rotation of the second sleeve.

13. The stage tool of claim 12, wherein the first sleeve comprises a bypass being opened with the first sleeve in the first open position and permitting fluid communication between opposing sides of the first seat.

14. The stage tool of claim 13, wherein the first sleeve comprises a sidewall having first and second annular seals disposed externally thereabout, the internal bore having first and second annular surfaces having the side port therebetween, the first and second annular seals with the first sleeve in the first closed position being sealed with the first and second annular surfaces, the first and second annular seals with the first sleeve in the first opened position being unsealed with the first and second annular surfaces, the first sleeve having a port therein, the port communicating an annular space as the bypass between the first sleeve and the internal bore with an internal passage of the first sleeve.

15. The stage tool of claim 12, wherein the first and second millable materials each comprises a composite material; and wherein the housing, the first sleeve, and the second sleeve are each composed of a metal material.

16. The stage tool of claim 12, wherein the second sleeve comprises a sidewall having first and second annular seals disposed externally thereabout, the internal bore having first and second annular surfaces having the side port therebetween, the first and second annular seals with the first sleeve in the second opened position being unsealed with the first and second annular surfaces, the first and second annular seals with the second sleeve in the second closed position being sealed with the first and second annular surfaces.

17. The stage tool of claim 12, wherein the housing defines an annular groove in the internal bore; and wherein the second sleeve comprises a biased ring disposed thereabout, the biased ring with the second sleeve in the second closed condition being configured to engage in the annular groove.

18. The stage tool of claim 12, wherein the first temporary connection comprises a first shear pin engaged between the first sleeve and the internal bore of the housing; and wherein the second temporary connection comprises a second shear pin engaged between the second sleeve and the internal bore of the housing.

19. The stage tool of claim 12, wherein the housing comprises a first sub-housing having a pin end and a first connection end; and a second sub-housing having a box end and a second connection end, the first and second connection ends coupled together, the first sleeve and the second sleeve being assembled in the first sub-housing.

20. The stage tool of claim 12, wherein the first engagement comprises a tapered end disposed on the first sleeve and being engageable in a tapered surface of the internal bore; and wherein the second engagement comprises first castellations defined on a first end of the first sleeve and second castellations defined on a second end of the second sleeve, the first and second castellations being engageable with one another.

21. The stage tool of claim 12, wherein the first and second sleeves are unconnected, the first sleeve being separately movable in the internal bore relative the second sleeve.

22. A stage tool used in a wellbore and being opened with a first plug and being closed with a second plug, the stage tool comprising:

a housing having an internal bore and defining a side port, the side port communicating the internal bore with the wellbore;

a first sleeve movably disposed in the internal bore and being held in a first closed position with a first temporary connection, the first temporary connection being releasable in response to a first force, the first sleeve in the first closed position closing communication between the side port and the internal bore, the first sleeve having a first seat disposed therein, the first seat being configured to engage the first plug, the first seat being engaged against a tapered shoulder in an internal passage of the first sleeve, the first seat having a seal sealed against the internal passage and having a snap ring engaged in an inner groove of the internal passage, the first sleeve in response to release of the first temporary connection due to the first force being movable from the first closed position to a first opened position, the first sleeve in the first opened position opening communication between the side port and the internal bore, the first sleeve in a final position in the bore having a first engagement with the internal bore configured to prevent rotation of the first sleeve; and a second sleeve movably disposed in the internal bore and held with a second temporary connection, the second temporary connection being releasable in response to a second force, the second sleeve in a second opened position opening communication between the side port and the internal bore, the second sleeve having a second seat disposed therein, the second seat being engaged against a tapered shoulder in an internal passage of the second sleeve, the second seat having a seal sealed against the internal passage and having a snap ring engaged in an inner groove of the internal passage, the second seat being configured to engage the second plug, the second sleeve in response to release of the second temporary connection due to the second force being movable from the second opened position to a second closed position, the second sleeve in the second closed position closing communication between the side port and the internal bore, the second sleeve in the second closed position having a second engagement with the first sleeve configured to prevent rotation of the second sleeve, wherein the first and second seats each comprise a composite material; and wherein the first and second sleeves each comprise a metal material.

* * * * *